US006341834B1

(12) United States Patent
Yokoi

(10) Patent No.: US 6,341,834 B1
(45) Date of Patent: Jan. 29, 2002

(54) RECORDING APPARATUS AND CONTROL METHOD THEREOF

(75) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/218,094

(22) Filed: Dec. 22, 1998

(30) Foreign Application Priority Data

Dec. 24, 1997 (JP) ..... 9-355001

(51) Int. Cl.[7] ..... B41J 29/38
(52) U.S. Cl. ..... 347/16; 347/14
(58) Field of Search ..... 347/16, 40, 14

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,540,996 | A | * | 9/1985 | Saito | 347/43 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 5,625,390 | A | * | 4/1997 | Burke et al. | 347/41 |

FOREIGN PATENT DOCUMENTS

| | | |
|---|---|---|
| EP | 0 408 071 | 1/1991 |
| EP | 0 554 907 | 8/1993 |
| EP | 0 566 318 | 10/1993 |
| EP | 0 679 518 | 11/1995 |
| JP | 54-056847 | 5/1979 |
| JP | 59-123670 | 7/1984 |
| JP | 59-138461 | 8/1984 |
| JP | 60-071260 | 4/1985 |

* cited by examiner

*Primary Examiner*—Thinh Nguyen
(74) *Attorney, Agent, or Firm*—Fitzpatrick, Cella, Harper & Scinto

(57) ABSTRACT

In the case of conducting the printing through the use of a print head having nozzles disposed at a pitch being twice a predetermined pitch Pd of recording dots, control is executed to satisfy the condition that, when a minimum integer 3 forming inter times a value 3 obtained by dividing a feed quantity L corresponding to the minimum drive unit of a drive motor by the predetermined recording dot pitch Pd is divided by an integer 2 obtained by dividing a pitch Ph of the nozzles of the print head by the recording dot pitch Pd, the residue 1 is not a divisor, above 2, of the integer 2 obtained by dividing the print head nozzle pitch Ph by the recording dot pitch Pd. Whereupon, it is possible to increase the recording medium conveying speed and further to realize high-quality recording at a small recording dot pitch.

16 Claims, 21 Drawing Sheets

: RECORDING DOTS THAT ARE FORMED BY SCANNING THE PRINT HEAD N TIMES

: RECORDING DOTS THAT ARE FORMED BY SCANNING THE PRINT HEAD N+1 TIMES

: RECORDING DOTS THAT ARE FORMED BY SCANNING THE PRINT HEAD N+2 TIMES

RECORDING APPARATUS AND CONTROL METHOD THEREOF

BACKGROUND OF THE INVENTION

1. Field of the Invention

The present invention relates to, for example, in a recording apparatus such as a printer for outputting information retained in a computer or the like or in an image forming apparatus such as a copying machine and a facsimile, a recording apparatus which records image data on a recording medium through the use of a recording head, and a control method therefor.

2. Description of Related Art

A prior recording apparatus is equipped with a print head in which nozzles for formation of recording dots on a recording medium are made at a predetermined pitch and a conveying mechanism for conveying the recording medium, on which printing is effected by this print head, at a predetermined timing, so that recording dots are formed on the recording medium, thereby accomplishing the recording.

In general, a conveying mechanism comprises a conveying roller made of a rubber or the like and a motor for driving the conveying roller, and is designed to convey a recording medium by transferring a driving force of the motor through a transfer mechanism such as a gear up to the conveying roller. In addition, a type providing a minimum drive unit, such as a stepping motor, is used as the motor, and the specification including the gear ratio and the roller diameter is determined so that the conveying quantity of the recording medium assumes a predetermined value with respect to the minimum drive unit of the motor.

Furthermore, hitherto, in cases where the nozzle pitch of a print head coincides with the pitch of the recording dots to be formed on the recording medium, the conveying quantity of a recording medium relative to the minimum drive unit of a drive motor equals the pitch of recording dots to be formed on the recording medium or assumes integer times the pitch of recording dots, and in the case that the nozzle pitch of the print head assumes integer times the pitch of the recording dots to be formed on the recording medium, the conveying quantity becomes equal to the pitch of the recording dots to be formed on the recording medium.

FIG. 21 is an illustration of a print pattern taken when a nozzle pitch of a print head assumes integer times the pitch of recording dots to be formed on a recording medium.

In FIG. 21, a distance Pd represents a pitch of recording dots formed on a recording medium, a distance Ph designates an arrangement pitch of nozzles of a print head, and a distance L denotes a recording medium conveying quantity at step of a stepping motor, where Ph=4Pd.

Columns C0 to C3 signify nozzle positions of the print head in conveying the recording medium. In this instance, a conveying quantity L corresponding to one step of the stepping motor is set to be equal to the recording dot pitch Pd, and if the recording medium is conveyed by a quantity being integer times of L in a feeding direction S of the recording medium in FIG. 21, the print head relatively shifts with respect to the recording medium as indicated by the columns C1, C2 and C3, and therefore, the recording dots can be formed on the recording medium at a predetermined recording dot pitch Pd.

The conveying quantity of the recording medium is set to integer times the basic conveying quantity L for the formation of the recording dots at the respective recording positions to correspond to the number of nozzles installed in the print head.

<Problems to be Solved By the Invention>

However, recently, it has been necessary to make the pitch of the recording dots smaller so that the quality of a recording image is higher, and the reduction of the pitch of the recording dots to be formed by a print head has quickly taken place.

For this reason, with the above-mentioned prior art construction, if the conveying quantity of a recording medium corresponding to the minimum drive unit of a stepping motor is set to be equal to the pitch of recording dots to be formed on the recording medium, the conveying quantity per one step of the stepping motor is reduced. However, since there is a limit to the number of steps to be allowed at the drive of the stepping motor within a constant time, the conveying speed of the recording medium becomes low, thereby causing the reduction of the throughput related to the performance of the recording apparatus.

In addition, for solving the aforesaid defect, there is a need to use a high-priced motor with a high drive performance, which increases the apparatus cost.

Moreover, in the case that the conveying quantity of a recording medium corresponding to the minimum drive unit of the stepping motor is set to integer times the pitch of recording dots to be formed on the recording medium, although the recording dot pitch is needed to be equal to the nozzle pitch of the print head, there is a limit to the reduction of the nozzle pitch of the print head, so that difficulty is experienced in reducing it to below a predetermined pitch, so that higher image quality recording becomes impossible.

Besides, since the reduction of the nozzle arrangement pitch of the print head involves the difficulty in processing, the cost of the print head rises, which has influence on the cost of the whole apparatus.

SUMMARY OF THE INVENTION

Accordingly, the present invention has been developed with view to eliminating the above-mentioned problems of the prior art, and it is an object of this invention to provide a low-cost recording apparatus which is capable of increasing a recording medium conveying speed and of accomplishing recording of a high quality at a small recording dot pitch, and further to provide a control method therefor.

For eliminating the above-mentioned problems and for achieving the purpose, a recording apparatus according to this invention is constructed as follows. That is, the recording apparatus comprises a recording head having a plurality of discharge ports for discharging inks, said plurality of discharge ports are arranged at a predetermined pitch, a scanning means for scanning the recording head in scanning (main scanning) directions, a conveying means for conveying a recording medium in a conveying (sub-scanning) direction, and a control means for controlling the conveying means at integer times the minimum conveying unit. The control means controls the conveying means so that ink is discharged onto a recording medium at a recording dot pitch obtained by dividing the predetermined pitch of the discharge ports by an integer above 2, and a conveying quantity of the recording medium corresponding to the minimum conveying unit of the conveying means becomes larger than the pitch of the recording dots to be formed on the recording medium.

For eliminating the above-mentioned problems and for achieving the purpose, a recording apparatus according to this invention is constructed as follows.

That is, according to this invention, a recording apparatus comprises a recording head having a plurality of discharge ports for discharging inks, said plurality of discharge ports are arranged at a predetermined pitch, a scanning means for scanning the recording head in scanning directions, a conveying means for conveying a recording medium in a conveying direction, and a control means for controlling the conveying means at integer times its minimum conveying unit. The recording head discharges ink onto a recording medium at a recording dot pitch obtained by dividing the predetermined pitch of the discharge ports by an integer above 2, while the control means controls the conveying means to, when the conveying quantity of the recording medium is taken to be L, the pitch of the discharge ports is taken as Ph and the recording dot pitch is taken as Pd, satisfy the condition of $Ph/Pd \geqq 2$ and $L>Pd$.

For eliminating the above-mentioned problems and for achieving the purpose, a control method for a recording apparatus according to this invention has the following features.

That is, according to this invention, in a control method for a recording apparatus comprising a recording head having a plurality of discharge ports for discharging inks, said plurality of discharge ports are arranged at a predetermined pitch, a scanning means for scanning the recording head in scanning directions, a conveying means for conveying a recording medium in a conveying direction, and a control means for controlling the conveying means at integer times its minimum conveying unit, the ink is discharged onto a recording medium at a recording dot pitch obtained by dividing the predetermined pitch of the discharge ports by an integer above 2, and the conveying means is controlled so that a feed quantity of the recording medium corresponding to the minimum conveying unit of the conveying means becomes larger than the pitch of the recording dots to be formed on the recording medium.

For eliminating the above-mentioned problems and for achieving the purpose, a control method for a recording apparatus according to this invention has the following features.

That is, according to this invention, in a control method for a recording apparatus comprising a recording head having a plurality of discharge ports for discharging inks, said plurality of discharge ports are arranged at a predetermined pitch, a scanning means for scanning the recording head in scanning directions, a conveying means for conveying a recording medium in a conveying direction, and a control means for controlling the conveying means at integer times its minimum conveying unit, the ink is discharged onto the recording medium at a recording dot pitch obtained by dividing the predetermined pitch of the discharge ports by an integer above 2, while the conveying means is controlled so that, when a conveying quantity of the recording medium is taken to be L, the pitch of the discharge ports is taken as Ph and the recording dot pitch is taken as Pd, the condition of $Ph/Pd \geqq 2$ and $L>Pd$ is satisfied.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Referring to the accompanying drawings, a detailed description will be made hereinbelow of embodiments of the present inventions.

<Construction of a Recording Apparatus>

Figure 1:
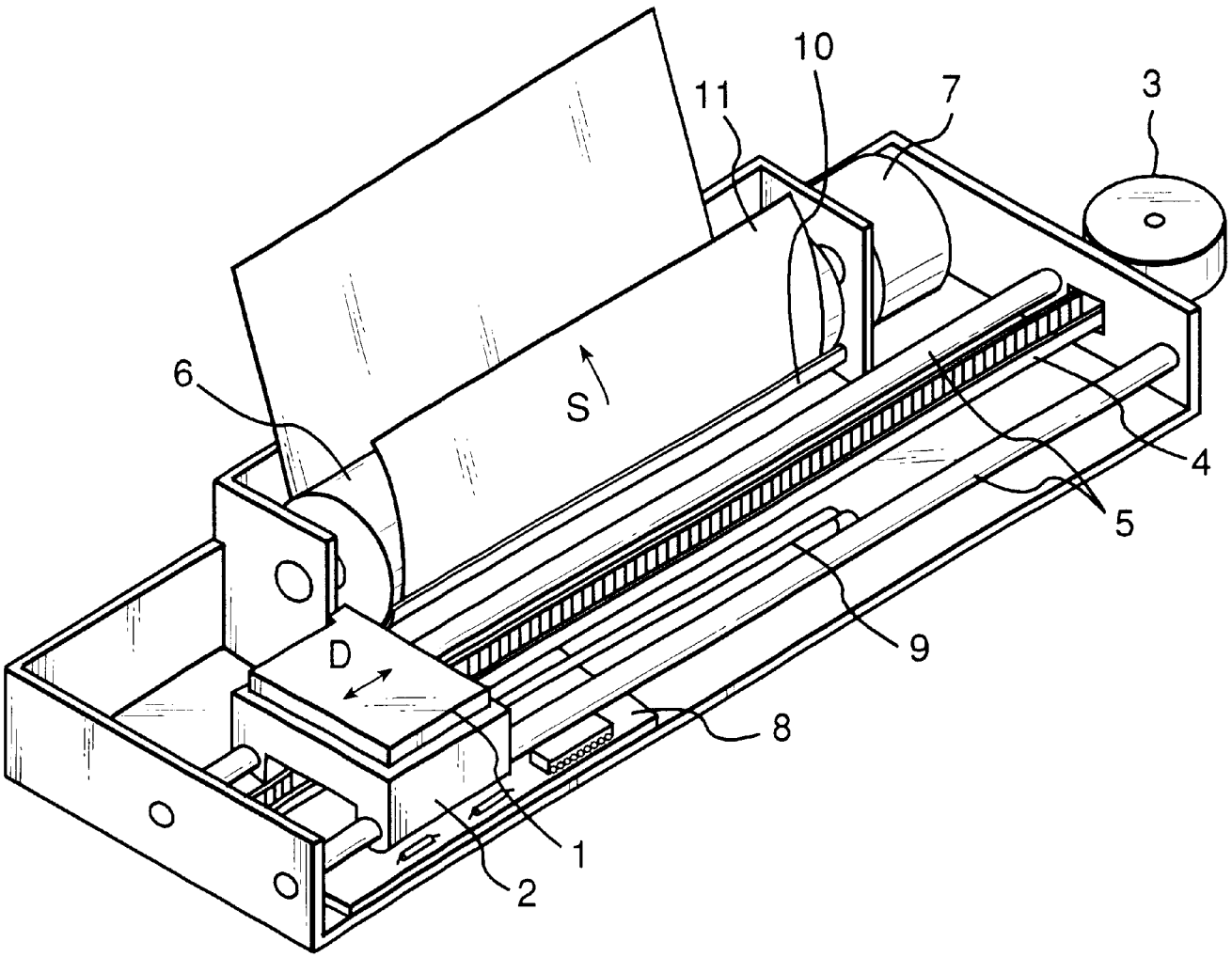
FIG. 1 is and external perspective view schematically showing a recording apparatus according to an embodiment of the present invention.

FIG. 1 is an external perspective view schematically showing a recording apparatus according to an embodiment of this invention.

As shown in FIG. 1, numeral 1 represents an ink jet pring head in which nozzles for discharging ink are arranged at a predetermined pitch, numeral 2 designates a carriage carrying the ink jet print head 1 to make the print head 1 scan in scanning (main scanning) directions D, numeral 3 denotes a carriage motor for driving the carriage 2 in the scanning directions D, numeral 4 depicts a carriage belt for driving the carriage 2 in the scanning directions D by a driving force of the carriage motor 3, numeral 5 stands for a carriage guide for guiding the carriage 2 along the scanning directions when the carriage 2 conducts a scanning operation, numeral 6 signifies a conveying roller for feeding a recording medium in a feed (sub-scanning) direction S, numeral 7 indicates a conveying motor, such as a stepping motor (or a motor with an encoder), for driving the conveying roller 6, which is driven by one frame in a minimum drive unit, numeral 8 stands for a control circuit, numeral 9 shows a flexible cable for transferring a head drive signal outputted from the control circuit 8 to the ink jet print head 1 mounted on the carriage 2, numeral 10 designates a guide member for determining the conveying direction of a recording medium, and numeral 11 denotes a recording medium such as a paper sheet and a film.

Figure 2:
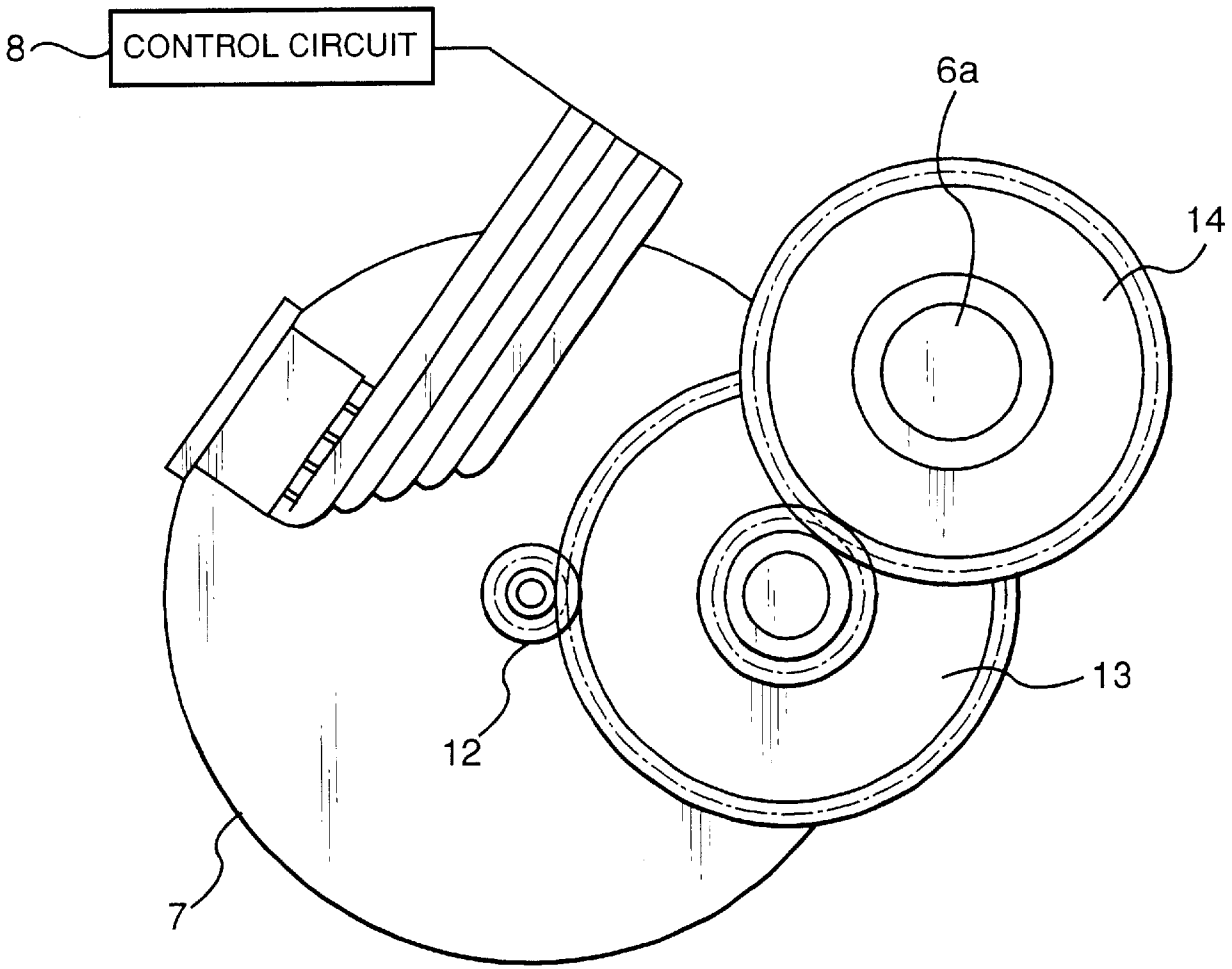
FIG. 2 is an illustration of a transfer mechanism for transferring a driving force between a conveying roller 6 and a conveying motor 7.

FIG. 2 is an illustration of a transfer mechanism for transferring a driving force between the conveying roller 6 and the conveying motor 7. In FIG. 2, numeral 12 represents a motor gear fitted over a roller shaft 6*a* of the conveying roller 6, and numeral 13 signifies an idler gear for transferring the driving force of the conveying motor 7 from the motor gear 12 to a roller gear 14. The conveying roller 6 is rotated by a predetermined angle corresponding to the minimum drive unit of the conveying motor 7, so that the recording medium is conveyed by that rotating quantity.

<Arrangement of a Control Circuit>

Figure 3:
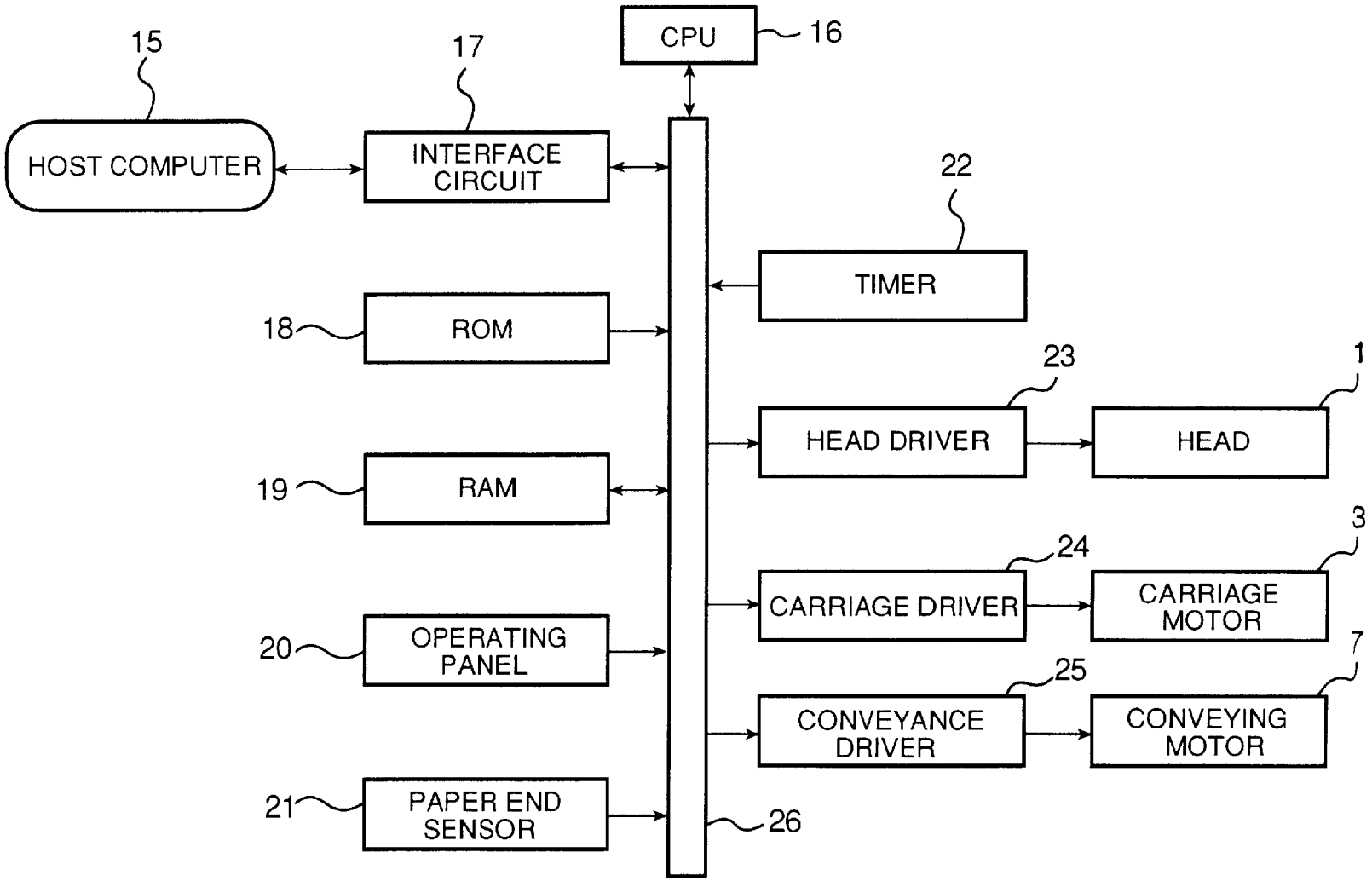
FIG. 3 is a block diagram showing an arrangement of a control circuit 8 shown in FIG. 8.
Figure 8:
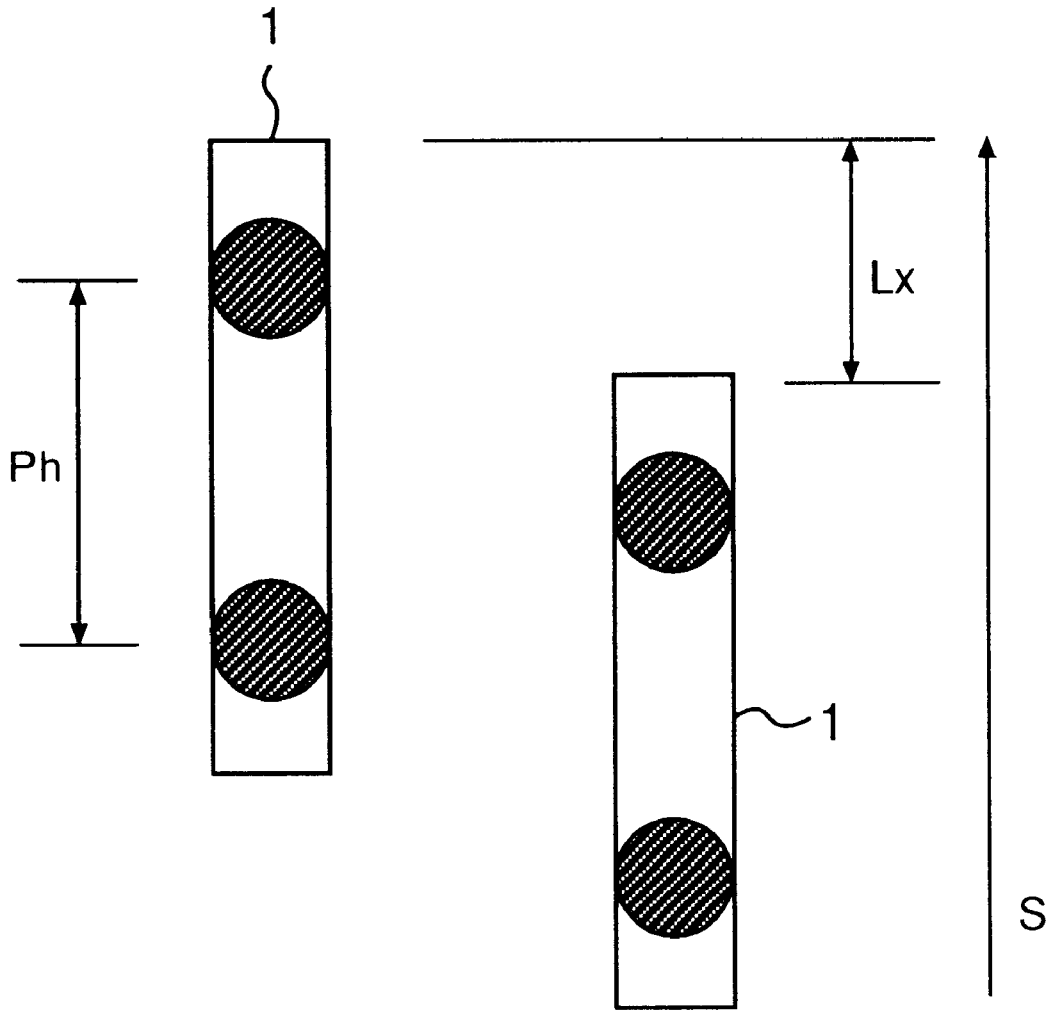
FIG. 8 is an illustration of the variation of a position of the pring head 1 relative to a recording medium, occurring when the recording medium is delivered a distance Lx in a feed direction S.

FIG. 3 is a block diagram showing an arrangement of the control circuit 8 in FIG. 8.

As shown in FIG. 3, a CPU 16, which is a microprocessor e.g., is connected through an interface circuit 17 and a common bus line 26 to a host computer 15. The CPU 16 controls the operation of recording apparatus on the basis of a recording stored in a program memory 18 serving as a ROM or record data (print data) stored in a buffer memory 19 acting as a RAM and outputted from the host computer 15.

The CPU 16 controls a carriage driver 24 connected to the common bus line 26 and the carriage motor 3, a conveyance driver 25 connected to the common bus line 26 and the conveying motor 7, and further controls the ink discharge from the nozzles of the print head 1 through the use of a head driver 23 on the basis of the print data stored in the RAM 19. An operating panel 20 is provided for the purpose of the operation of the recording apparatus, where the user can confirm the printing condition of the recording apparatus. The CPU 16, when a paper end sensor 21 detects an end portion of the recording medium, controls the conveying motor 7 so that the conveyance of the recording medium being forwarded in the feed direction stops.

<Recording Operation >

Figure 4:
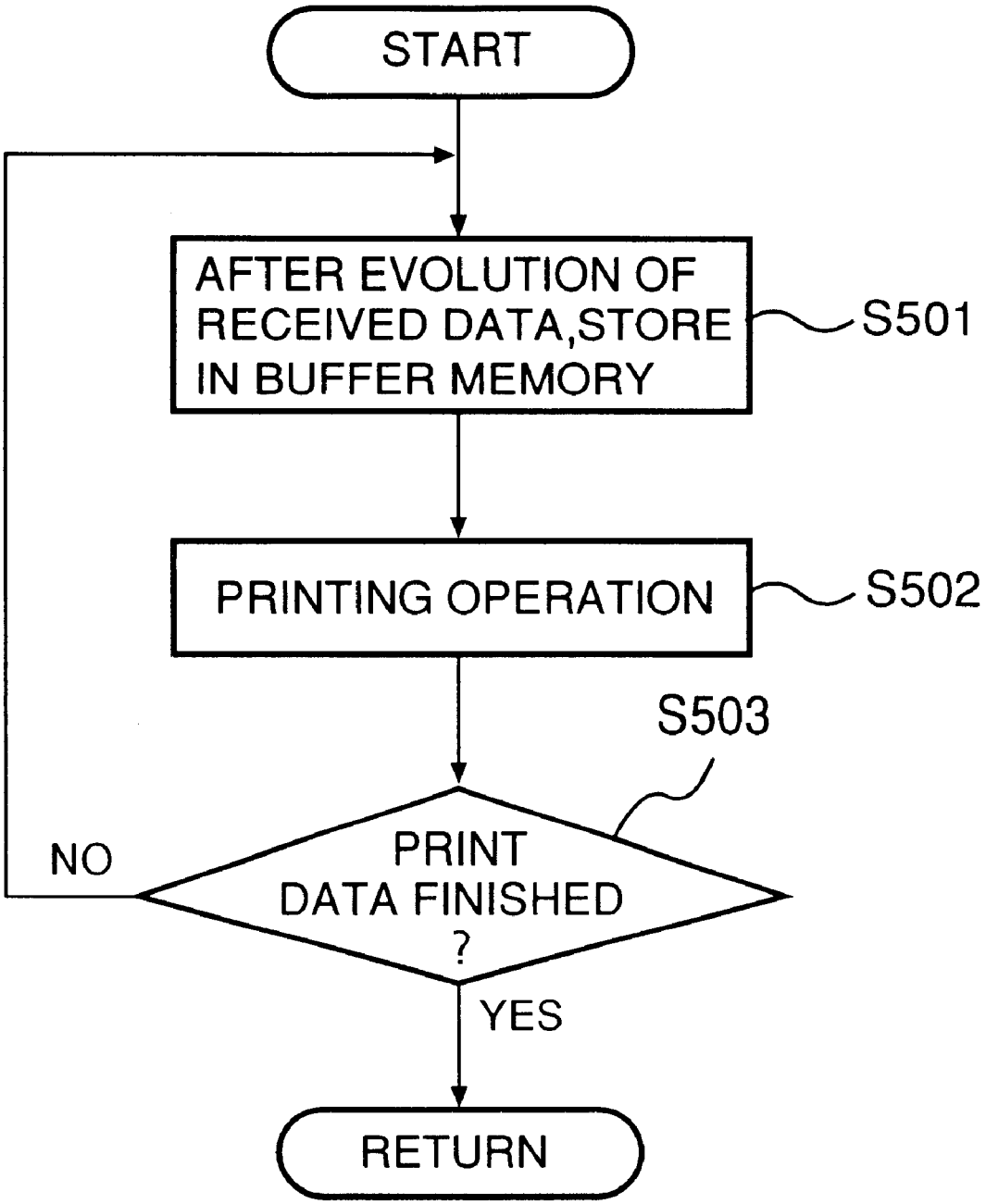
FIG. 4 is a flow chart showing a basic printing recording operation of the recording apparatus.
Figure 5:
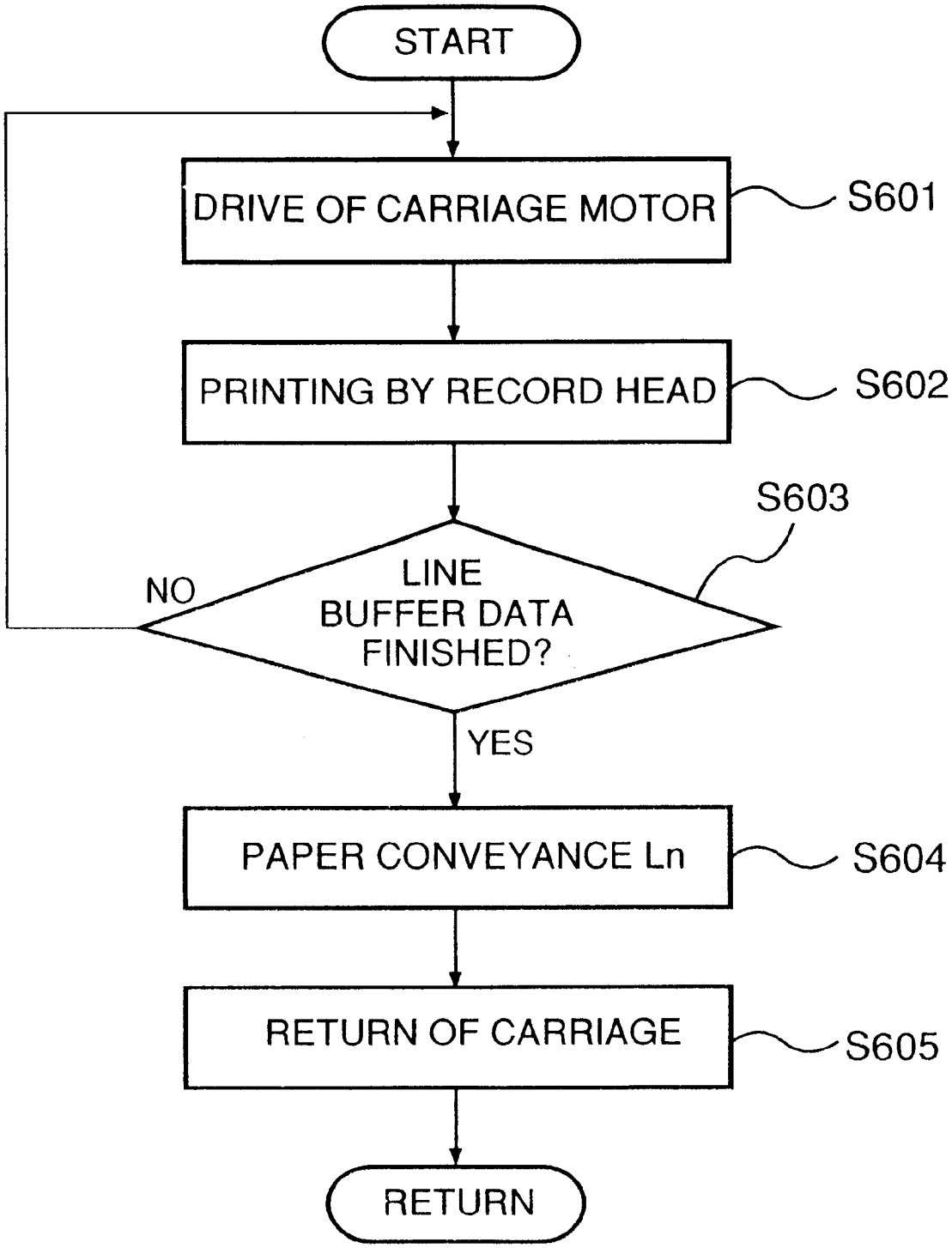
FIG. 5 is a flow chart showing a basic printing recording operation of the recording apparatus.

FIGS. 4 and 5 are flow charts showing a basic recording operation of the recording apparatus.

As shown in FIG. 4, when the processing starts, in a step S501, the CPU 16 expands a print signal received from the host computer 15 and sets the expanded print signal in a buffer memory of the RAM 19 for one scan so that it is printable by the print head 1.

In a step S502, the CPU 16 carries out the printing operation through the use of the print head 1 on the basis of the print data stored in the buffer memory, and in a step S503, waits for the completion of the printing operation.

A detailed description will be given hereinbelow of that printing operation.

As shown in FIG. 5, in a step S601, the CPU 16 drives the carriage motor 3 to make the carriage 2 scan the recording medium 11, while, in a step S602, ink is ejected from the nozzles of the ink jet type print head 1 mounted on the carriage 2 to form ink dots on the recording medium, thus conducting the printing operation.

After the completion of the printing of all of the print data in a line buffer in a step S603 (Yes in step S603), in a step S604, the conveying roller 6 is driven by the conveying motor 7 so that the recording medium is forwarded by a predetermined quantity Ln in the paper feed direction (sub-scanning direction).

In a step S605, the carriage 2 is returned to the start position, and the one-line printing operation reaches completion. Thereafter, in the case that the received data for the second line and the lines subsequent thereto are stored in the buffer memory, the operations of the steps S501 to S503 are repeatedly put into practice.

<Discharge of Ink from Print Head>

Figure 6:
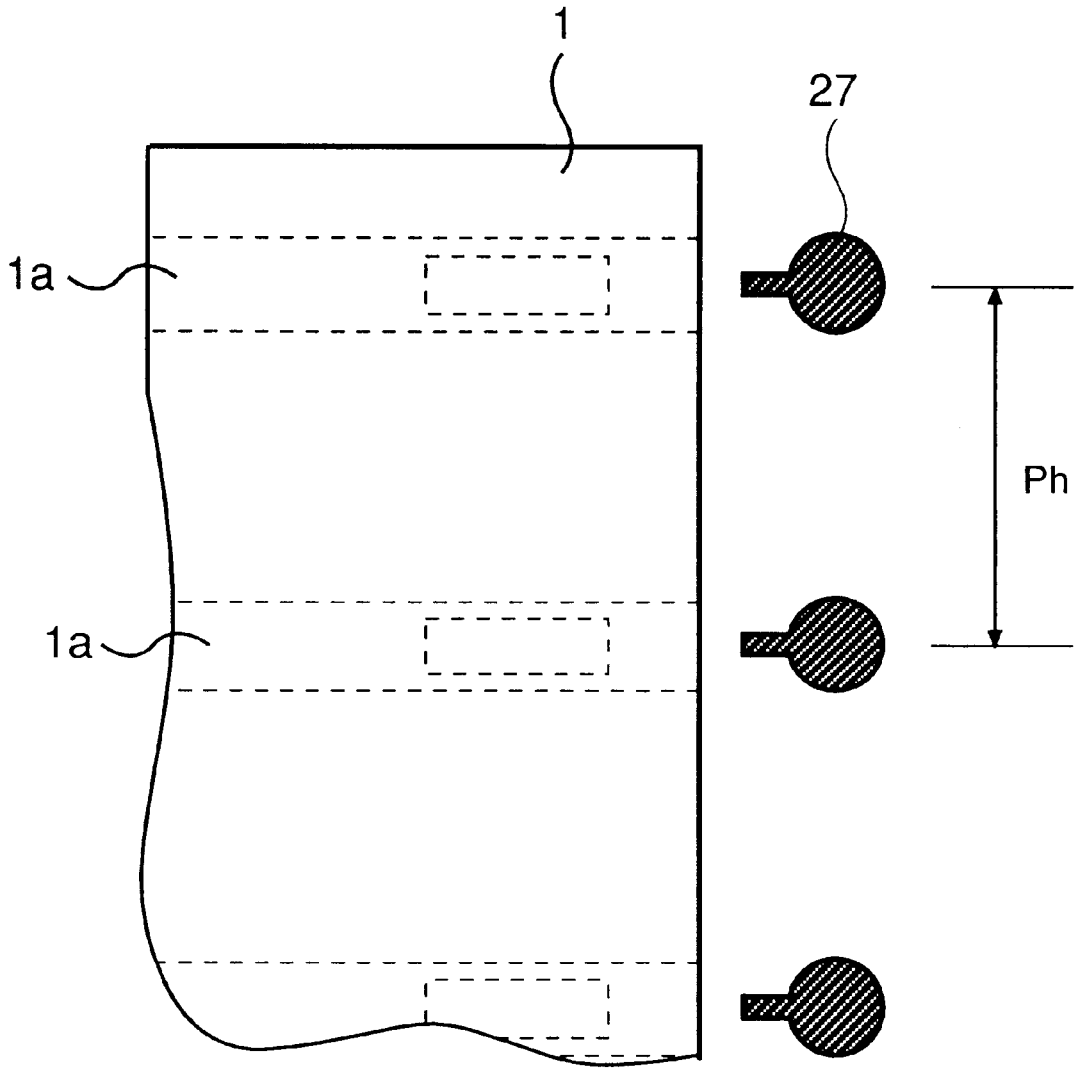
FIG. 6 is an enlarged view showing the vicinity of discharge ports of an ink jet print head 1.

FIG. 6 is an enlarged and simplified view showing the vicinity of the discharge ports of the ink jet print head 1 and a simplified view showing a configuration of the ink droplets 27.

As shown in FIG. 6, discharge ports 1*a* are made at an interval corresponding to a pitch Ph, and ink droplets 27 are discharged at the pitch Ph at the scanning of the print head 1 by the carriage 2. That is, recording dots are formed along the feed direction by one scanning of the ink jet print head 1.

Figure 7:
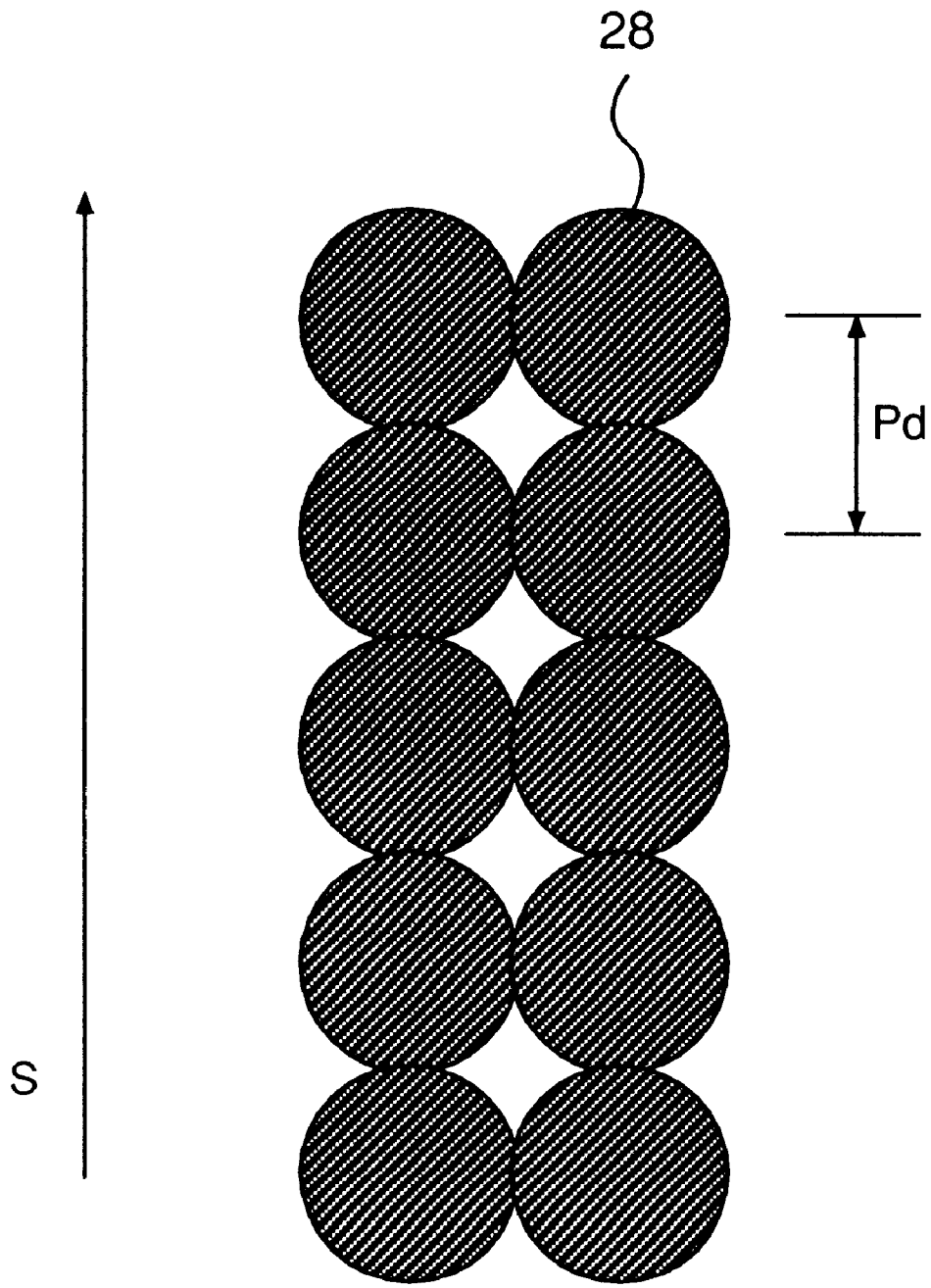
FIG. 7 is an illustration of recording dots formed on a recording medium.

FIG. 7 is an illustration of recording dots formed on a recording medium. As shown in FIG. 7, recording dots 28 are formed at the pitch Pd along the feed direction S of the recording medium.

FIG. 8 is an illustration of the variation of the print head 1 relative to a recording medium in the case that the recording medium is forwarded by an arbitrary distance Lx in the feed direction S.

As shown in FIG. 8, when the recording medium is sent by the feed quantity Lx in the feed direction S, the relative position of the print head 1 with respect to the recording medium is relatively shifted by the distance Lx with respect to the feed direction S at the scanning, and hence, recording dots shifted by the distance Lx are formed on the recording medium before and after the recording medium is sent in the feed direction S.

<Relationship Among Feed (Sub-scanning) Quantity, Nozzle Pitch and Recording Dot Pitch>

<First Embodiments>

Figure 9:
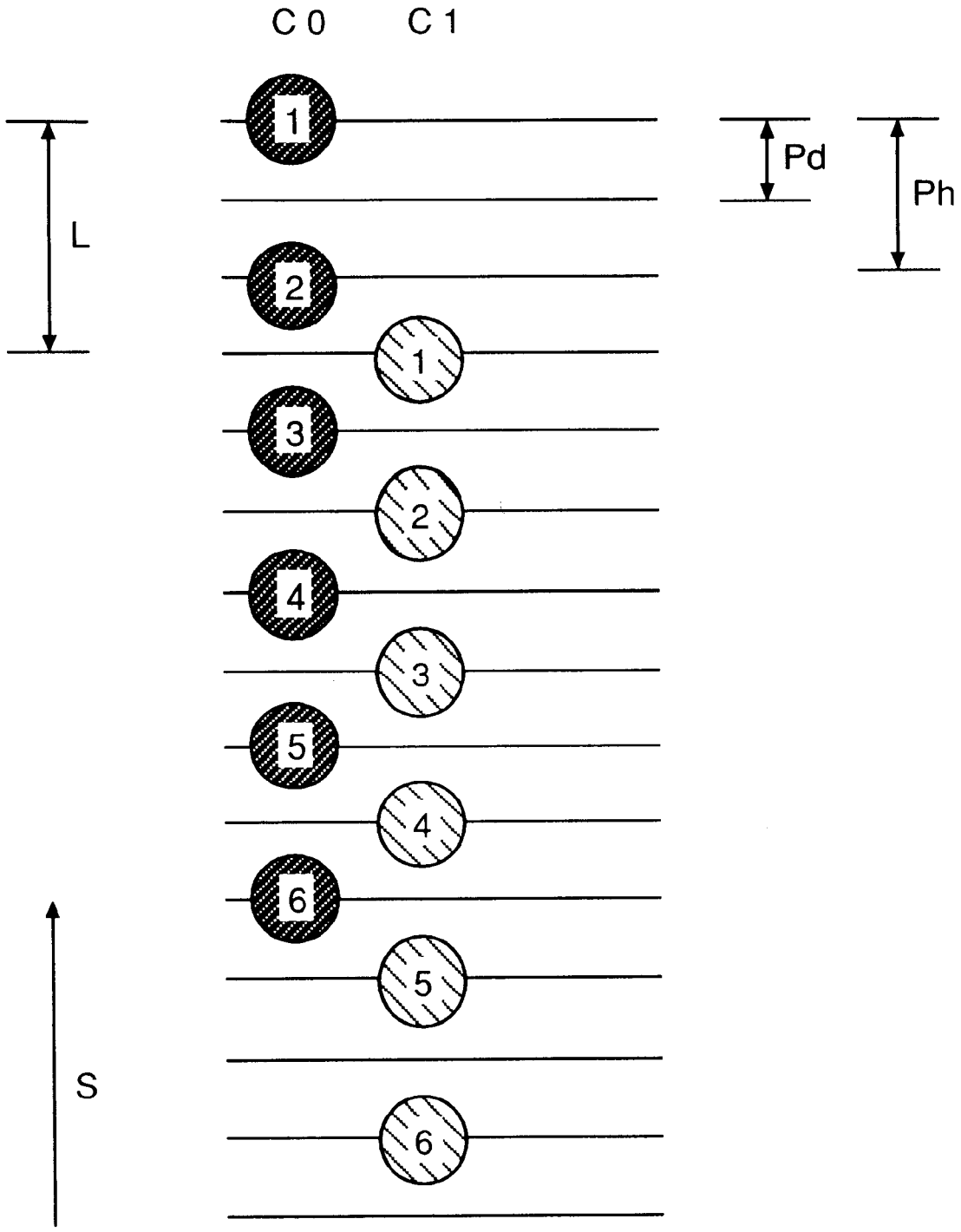
FIG. 9 is an illustration of the relationship among a feed quantity L of a recording medium corresponding to the minimum drive unit of a conveying motor, a pitch Ph of nozzles in a print head and a pitch Pd of recording dots to be formed on the recording medium in a first embodiment.

FIG. 9 is an illustration of the relationship among a feed quantity L of a recording medium corresponding to the minimum drive unit of a conveying motor (for example, one step of a stepping motor), a pitch Ph of nozzles of a print head and a pitch Pd of recording dots to be formed on the recording medium in a first embodiment. Incidentally, the first embodiment is realizable with the recording apparatus shown in FIG. 1.

As shown in FIG. 9, the print head nozzle pitch Ph is twice the pitch Pd of recording dots to be formed on the recording medium, and the feed quantity L of the recording medium corresponding to the minimum drive unit of the conveying motor is set to three times the pitch Pd of recording dots to be formed on the recording medium.

In FIG. 9, a print column C0 indicates the nozzle positions of the print head along the recording medium feed direction S, and each of the nozzle positions is expressed with a number allocated to each of the recording dots.

If the recording medium is forwarded by the feed quantity L in the feed direction S, as indicated by the column C1, the print head is shifted by the feed quantity L with respect to the recording medium, and therefore, recording dots are formed on the recording medium in a state of being shifted by the feed quantity L at the predetermined recording dot pitch Pd.

More specifically, in the case that the printing is done by employing a print head having nozzles disposed at a pitch being twice the predetermined recording dot pitch Pd, if the minimum integer (in this embodiment, "3") forming integer times a value (in this embodiment, "3") obtained by dividing the feed quantity L corresponding to the minimum drive unit of a drive motor by a predetermined recording dot pitch Pd is divided by an integer (in this embodiment, "2") obtained by dividing a print head nozzle pitch Ph by the recording dot pitch Pd and that residue (in this embodiment, "1") is not a divisor, above "2", of the integer (in this embodiment, "2") obtained by dividing the print head nozzle pitch Ph by the recording dot pitch Pd, as shown in FIG. 9, the printing is feasible in a state where the print head is shifted relatively with respect to the recording medium, and even in the case of using a print head having nozzles disposed at a nozzle pitch 2Pd being twice the recording dot pitch Pd, the formation of recording dots is realizable at a predetermined recording dot pitch Pd.

Although the description of this embodiment has been made of the case of Ph/Pd=2 and L=3Pd, if values m, n and K satisfying the following relations exist, naturally, the above-mentioned condition is realizable.

That is, $$L>Pd$$

$$m\times L=n\times Ph+K\times Pd$$

m: a minimum integer making "m×L" as an integer n: an arbitrary integer above 0

K: any one of integers from 1 to {(Ph/Pd)−1} except divisors, but 1, of an integer "Ph/Pd"

Figure 10:
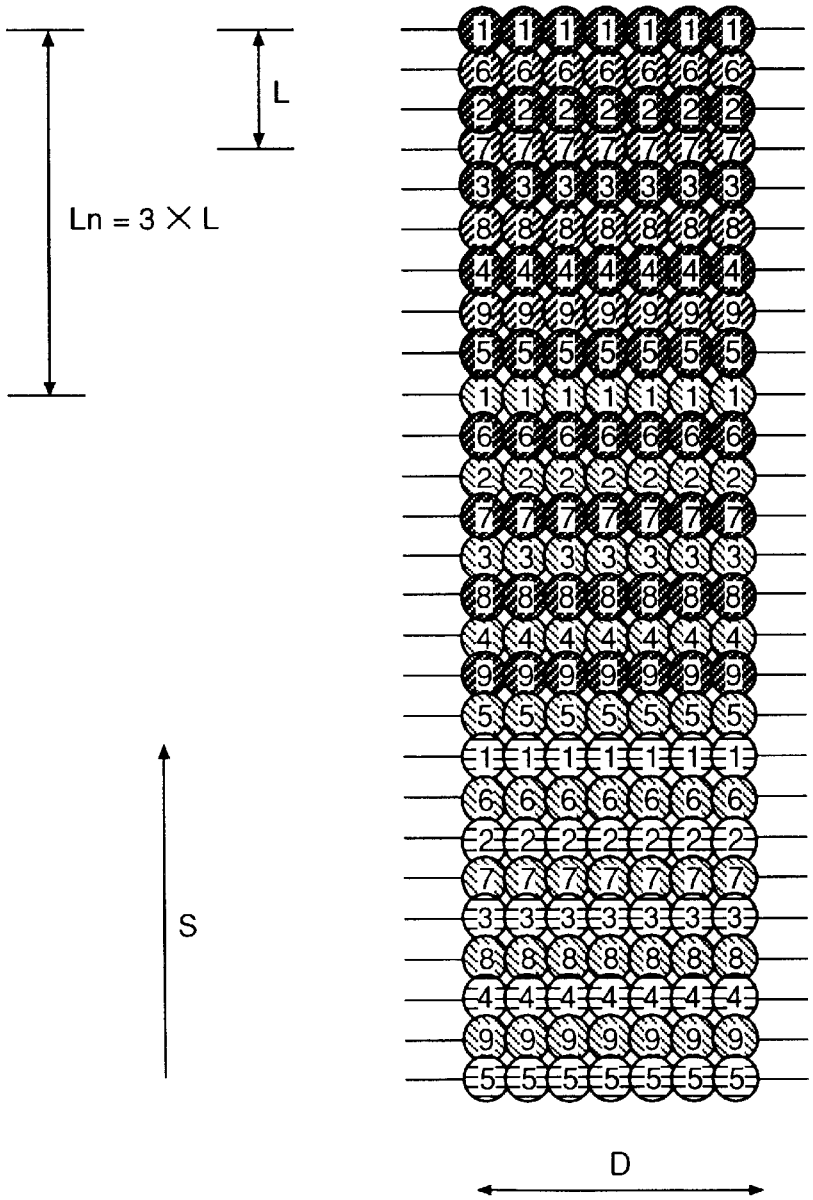
FIG. 10 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium in the printing example of FIG. 9 are determined on the condition that the number of nozzles of the print head is at 9 and the feed quantity Ln of the recording medium per line is set to $Ln=3L$.

FIG. 10 is an illustration of an example of formation of the recording dots shown in FIG. 9, and shows a state of formation of recording dots in the case that the feed quantity L of a recording medium corresponding to the minimum drive unit of a conveying motor (for example, one step of a stepping motor), the pitch Ph of nozzles in a print head and the pitch Pd of recording dots to be formed on the recording medium are determined on the condition that the number of nozzles of the print head is at 9 and the feed quantity Ln of the recording medium per line is set to Ln=3L.

FIG. 10 also shows an example of recording dots formed by scanning the print head a plurality of times. Numerals of the dots correspond to the nozzles respectively.

When the feed quantity L of a recording medium corresponding to the minimum drive unit of a conveying motor, the pitch Ph of nozzles in a print head and the pitch Pd of recording dots to be formed on the recording medium are set on the above-mentioned condition, as compared with the case that the feed quantity L of a recording medium corresponding to the minimum drive unit of a drive motor is set to be equal to the recording dot pitch Pd like the prior art, the recording medium can be forwarded at a several times higher speed.

Moreover, in the case that the recording medium feed speed is set to be equal to that in the prior art, even a low-priced stepping motor providing a lower number of steps to be taken per a constant time is available, which contributes to the reduction of the cost of the recording apparatus.

<Second Embodiment>

Figure 11:
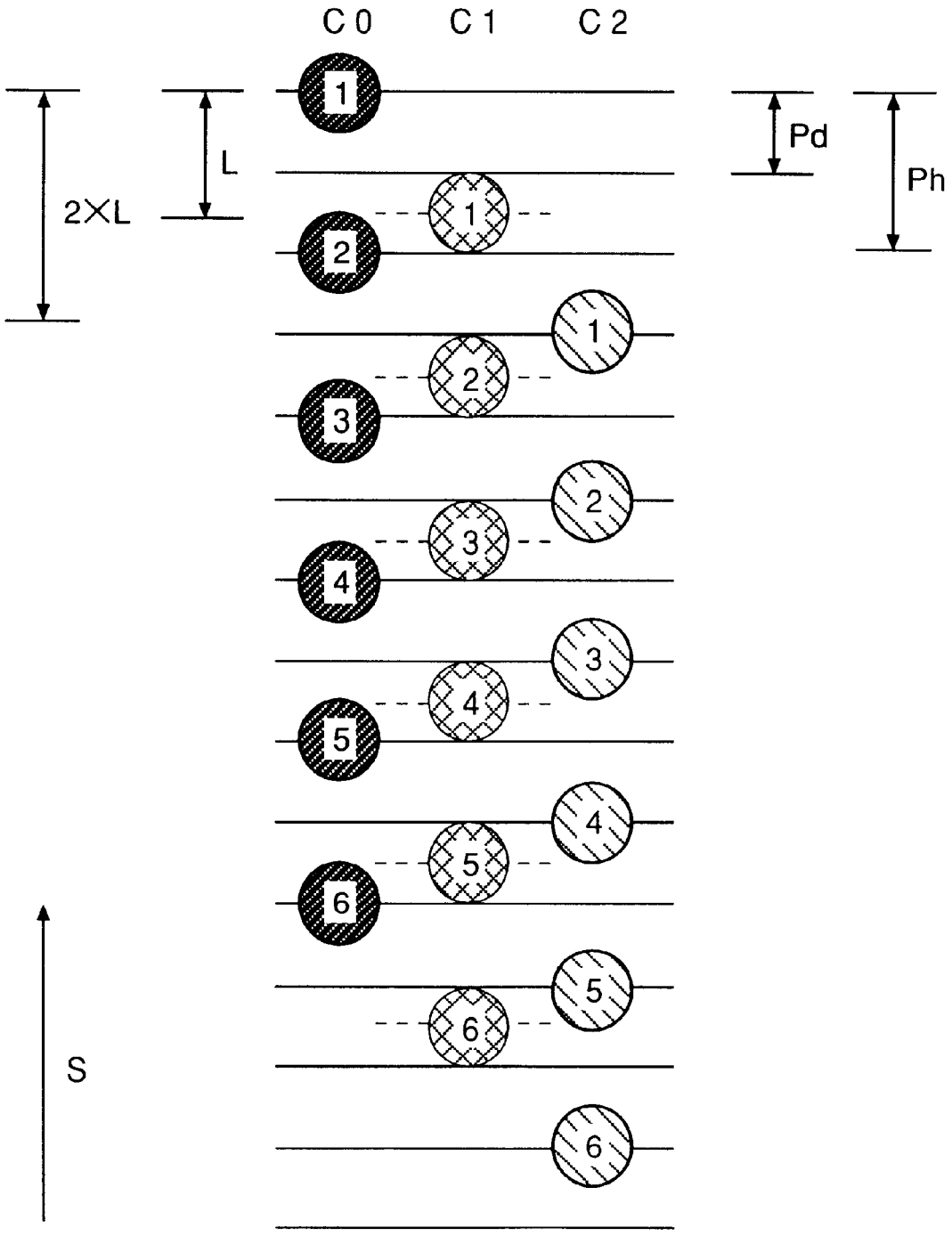
FIG. 11 is an illustration of the relationship among a feed quantity L of a recording medium corresponding to the minimum drive unit of a conveying motor, a pitch Ph of nozzles in a print head and a pitch Pd of recording dots to be formed on the recording medium in a second embodiment.

FIG. 11 is an illustration of the relationship among a feed quantity L of a recording medium corresponding to the minimum drive unit of a conveying motor, a pitch Ph of nozzles of a print head and a pitch Pd of recording dots to be formed on the recording medium in a second embodiment. Incidentally, the second embodiment is realizable with the recording apparatus shown in FIG. 1.

As shown in FIG. 11, the print head nozzle pitch Ph is twice the pitch Pd of recording dots to be formed on the recording medium, and the feed quantity L of the recording medium corresponding to the minimum drive unit of the conveying motor is 1.5 times the pitch Pd of recording dots to be formed on the recording medium.

A print column C0 indicates nozzle positions of the print head along the feed direction S of the recording medium, and each of the nozzle positions is represented by a number.

If the recording medium is forwarded by the feed quantity L in the feed direction S indicated in FIG. 11, the print head is shifted relatively with the recording medium as indicated by print columns C1 and C2, and hence, dots can be formed on the recording medium at the predetermined recording dot pitch Pd.

In this case, since a value corresponding to odd number times the feed quantity L does not establish the predetermined dot pitch Pd, a value corresponding to even-number times the feed quantity L is used as the feed quantity Ln for the formation of the recording dots at the pitch Pd.

More specifically, even in the case of employing a print head having nozzles disposed at a nozzle pitch 2Pd forming twice the recording dot pitch Pd, if the minimum integer (in this embodiment, "3") forming integer (in this embodiment, "2") times a value (in this embodiment, "1.5") obtained by dividing the feed quantity L of the recording medium corresponding to the minimum drive unit of the drive motor by the predetermined pitch Pd of recording dots placed on the recording medium is divided by an integer (in this embodiment, "2") obtained by dividing the print head nozzle pitch Ph by the recording dot pitch Pd and the residue (in this embodiment, "1") is not a divisor, above "2", of the integer (in this embodiment, "2") obtained by dividing the print head nozzle pitch Ph by the recording dot pitch Pd, as shown in FIG. 11, the print head can be shifted relatively with respect to the recording medium, and even in the case of using a print head having nozzles disposed at the nozzle pitch 2Pd being twice the recording dot pitch Pd, the formation of recording dots is realizable at the predetermined recording dot pitch Pd.

Although the description of this embodiment has been made of the case that Ph/Pd=2 and L=1.5 Pd, if values m, n and K which satisfy the following relations exist, the above-mentioned relation is naturally realizable.

That is, $$L>Pd$$

$$m\times L=n\times Ph+K\times Pd$$

m: a minimum integer making "m×L"as an integer n: an arbitrary integer above 0

K: any one of integers from 1 to {(Ph/Pd)−1} except divisors, but 1, of an integer "Ph/Pd"

Figure 12:
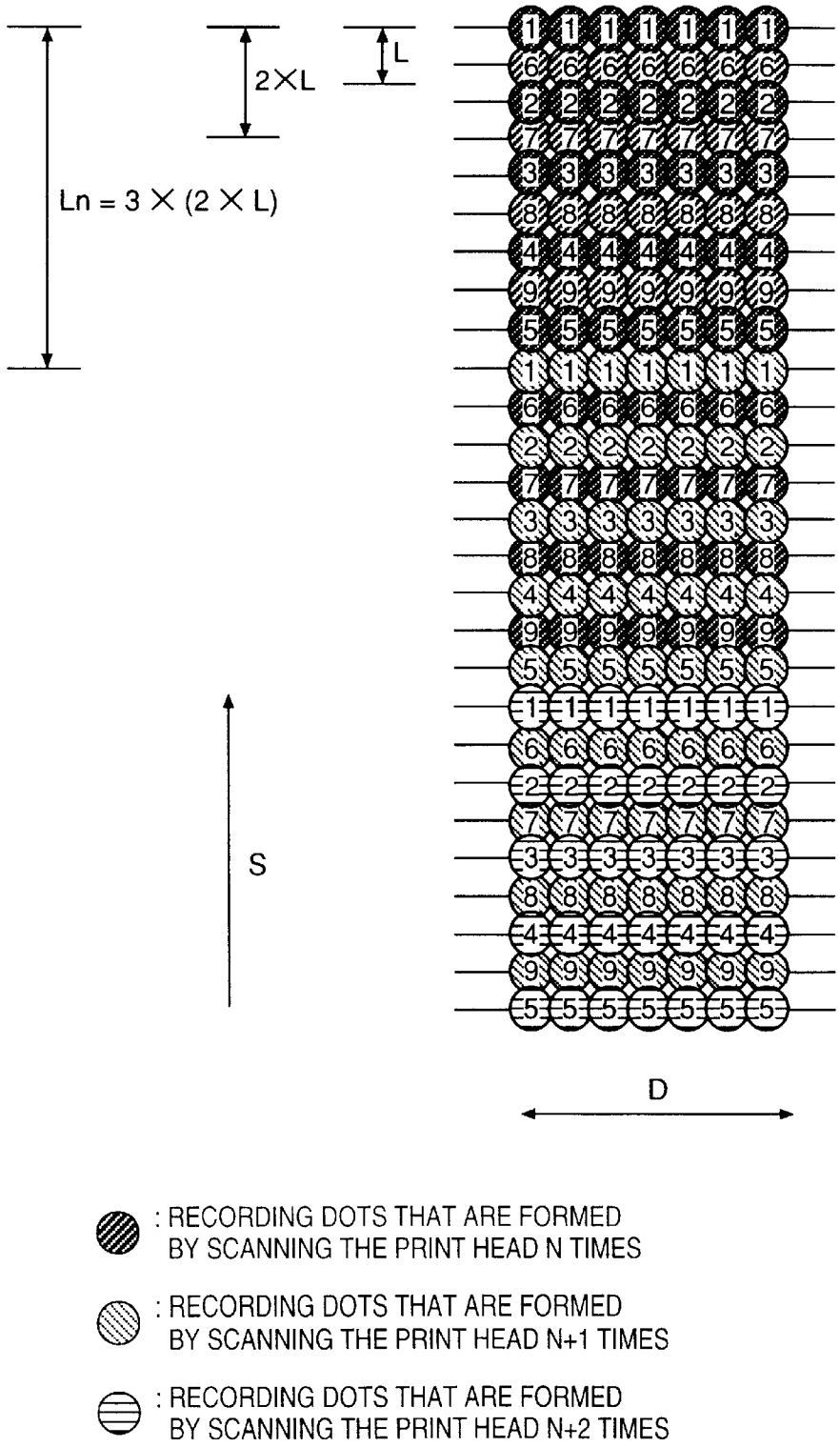
FIG. 12 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium in FIG. 11 are determined on the condition that the number of nozzles of the print head is at 9 and the feed quantity Ln of the recording medium per line is set to $Ln=3\times(2\times L)$.

FIG. 12 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium are determined on the condition that the number of nozzles of the print head is at 9 and the feed quantity Ln of the recording medium per line is set to Ln=3×(2×L).

FIG. 12 also shows an example of recording dots formed by scanning the print head plurality of times. Numerals of the dots corresponds to the nozzles respectively.

When the feed quantity L of a recording medium corresponding to the minimum drive unit of a conveying motor, the pitch Ph of nozzles in a print head and the pitch Pd of recording dots to be formed on the recording medium are set on the above-mentioned condition, as compared with the case that the feed quantity L of a recording medium corresponding to the minimum drive unit of a drive motor is set to be equal to the recording dot pitch Pd like the prior art, the recording medium can be forwarded at a several times higher speed.

Moreover, in the case that the recording medium feed speed is set to be equal to that in the prior art, even a low-priced stepping motor providing a lower number of steps to be taken per a constant time is available, which contributes to the reduction of the cost of the recording apparatus.

In addition, in this embodiment, since for the conveyance the feed quantity Ln in the feed direction S is always taken to be even-number times the minimum drive unit of the conveying motor (that is, integer times of 2L), and therefore, if the motor to be put to use is a two-phase stepping motor, the factor to the rotational angle errors due to the phase of the motor is reset at 2L, thereby providing higher-accuracy feeding (sub-scanning). Incidentally, although this embodiment takes m=2, if a three-phase motor is taken, m=3, and if a five-phase motor is employed, m=5, and even in these cases, naturally the same effects are obtainable.

<Third Embodiment>

Figure 13:
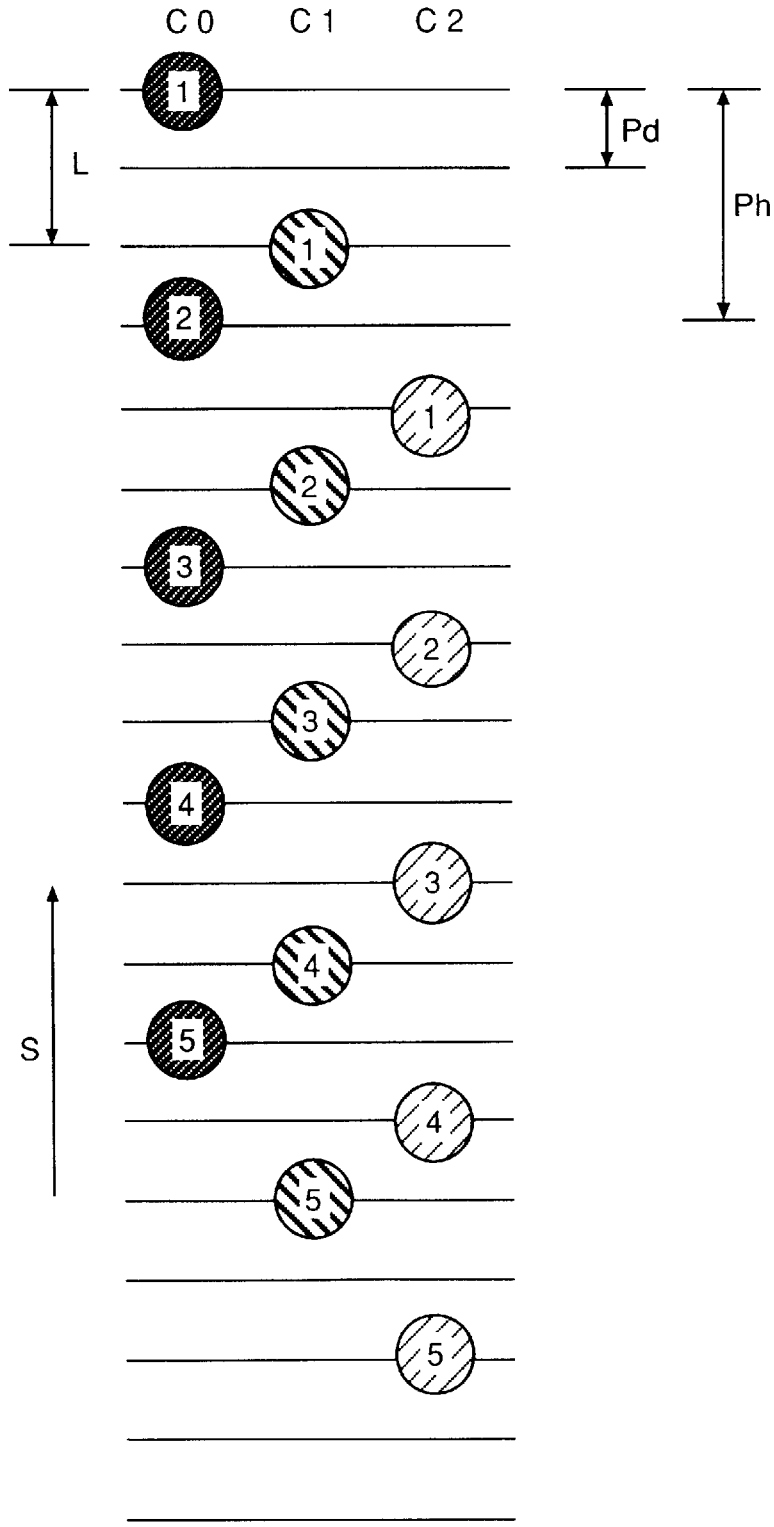
FIG. 13 is an illustration of the relationship among a feed quantity L of a recording medium corresponding to the minimum drive unit of a conveying motor, a pitch Ph of nozzles in a print head and a pitch Pd of recording dots to be formed on the recording medium in a third embodiment.

FIG. 13 is an illustration of the relationship among a feed quantity L of a recording medium corresponding to the minimum drive unit of a conveying motor, a pitch Ph of nozzles in a print head and a pitch Pd of recording dots to be formed on the recording medium in a third embodiment. Incidentally, the third embodiment is realizable with the recording apparatus shown in FIG. 1.

As shown in FIG. 13, the print head nozzle pitch Ph is three times the pitch Pd of recording dots to be formed on a recording medium, and the feed quantity L of the recording medium corresponding to the minimum drive unit of a conveying motor is twice the pitch Pd of recording dots to be formed on the recording medium.

A print column C0 denotes nozzle positions of the print head along the feed direction of the recording medium, and each of the nozzle positions is expressed by a number.

If the recording medium is forwarded by the feed quantity L in the feed direction S in FIG. 13, the print head is shifted relatively with the recording medium as indicated by print columns C1 and C2, and hence, recording dots can be formed on the recording medium at the predetermined recording dot pitch Pd.

More specifically, even in the case of employing a print head having nozzles disposed at a nozzle pitch 3 Pd forming three times the recording dot pitch Pd, if the minimum integer (in this embodiment, "2") forming integer (in this embodiment, "1") times a value (in this embodiment, "2") obtained by dividing the feed quantity L of the recording medium corresponding to the minimum drive unit of the drive motor by the predetermined pitch Pd of recording dots placed on the recording medium is divided by an integer (in this embodiment, "3") obtained by dividing the print head nozzle pitch Ph by the recording dot pitch Pd and the residue (in this embodiment, "2") is not a divisor, above "2", of the integer (in this embodiment, "3") obtained by dividing the print head nozzle pitch Ph by the recording dot pitch Pd, as shown in FIG. 13, the print head can be shifted relatively, and even in the case of using a print head having nozzles disposed at the nozzle pitch 3Pd being three times the recording dot pitch Pd, the formation of recording dots is realizable at the predetermined recording dot pitch Pd.

Although the description of this embodiment has been made of the case that Ph/Pd=3 and L=2 Pd, if values m, n and K which satisfy the following relations exist, the above-mentioned relation is naturally realizable.

That is, $$L>Pd$$

$$m\times L\ n=Ph+K\times Pd$$

m: a minimum integer making "m×L" as an integer n: an arbitrary integer above 0

K: any one of integers from 1 to {(Ph/Pd)−1} except divisors, but 1, of an integer "Ph/Pd"

Figure 14:
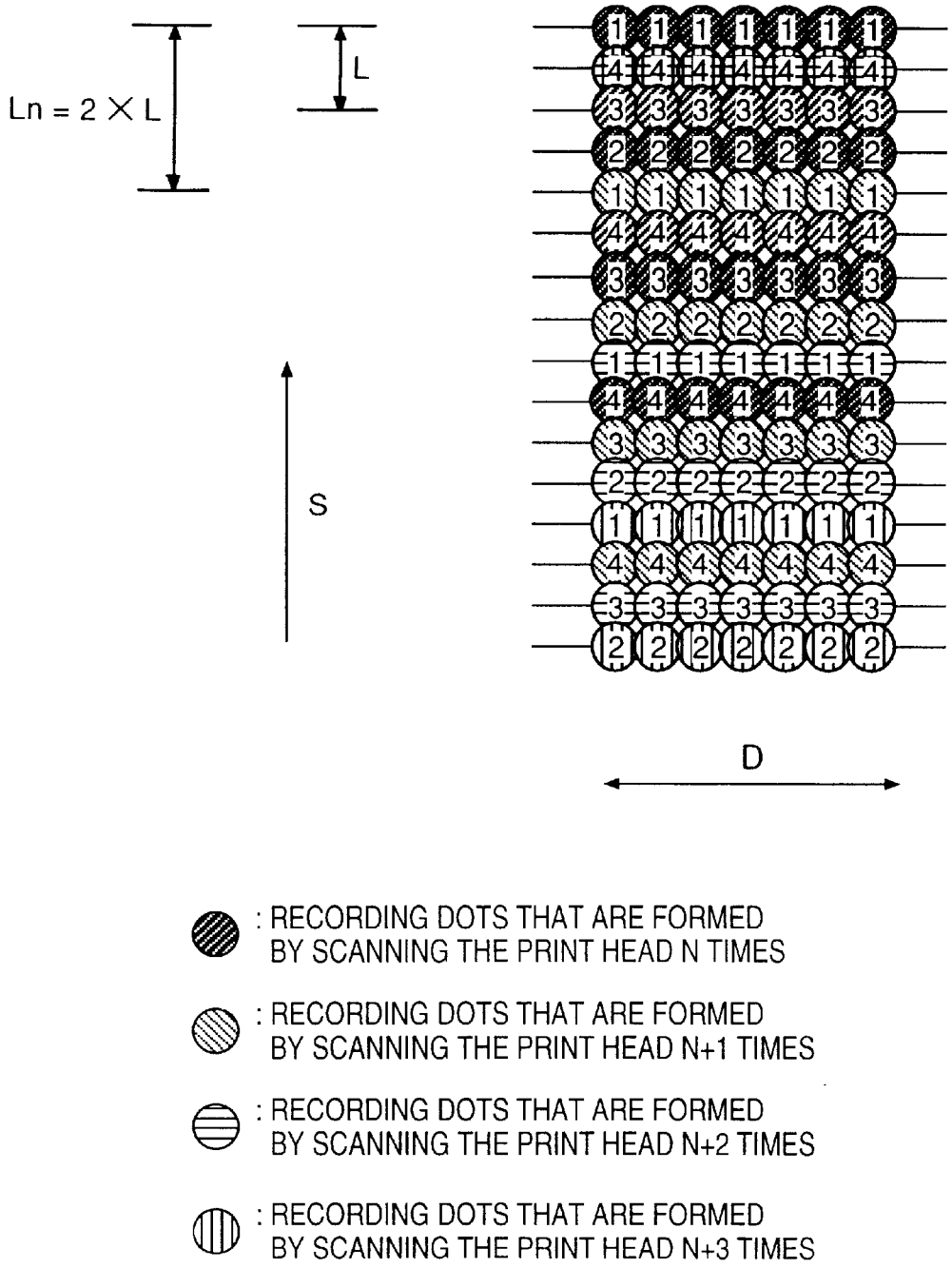
FIG. 14 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium in FIG. 13 are determined on the condition that the number of nozzles of the print head is at 4 and the feed quantity Ln of the recording medium per line is set to $Ln=2\times L$.

FIG. 14 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium in FIG. 13 are determined on the condition that the number of nozzles of the print head is at 4 and the feed quantity Ln of the recording medium per line is set to Ln=2×L.

FIG. 14 also shows an example of recording dots formed by scanning the print head plurality of times. Numerals of the dots corresponds to the nozzles respectively.

When the feed quantity L of a recording medium corresponding to the minimum drive unit of a conveying motor, the pitch Ph of nozzles in a print head and the pitch Pd of recording dots to be formed on the recording medium are set on the above-mentioned condition, as compared with the case that the feed quantity L of a recording medium corresponding to the minimum drive unit of a drive motor is set to be equal to the recording dot pitch Pd like the prior art, the recording medium can be forwarded at a several times higher speed.

Moreover, in the case that the recording medium feed speed is set to be equal to that in the prior art, even a low-priced stepping motor providing a lower number of steps to be taken per a constant time is available, which contributes to the reduction of the cost of the recording apparatus.

<Fourth Embodiment>

Figure 15:
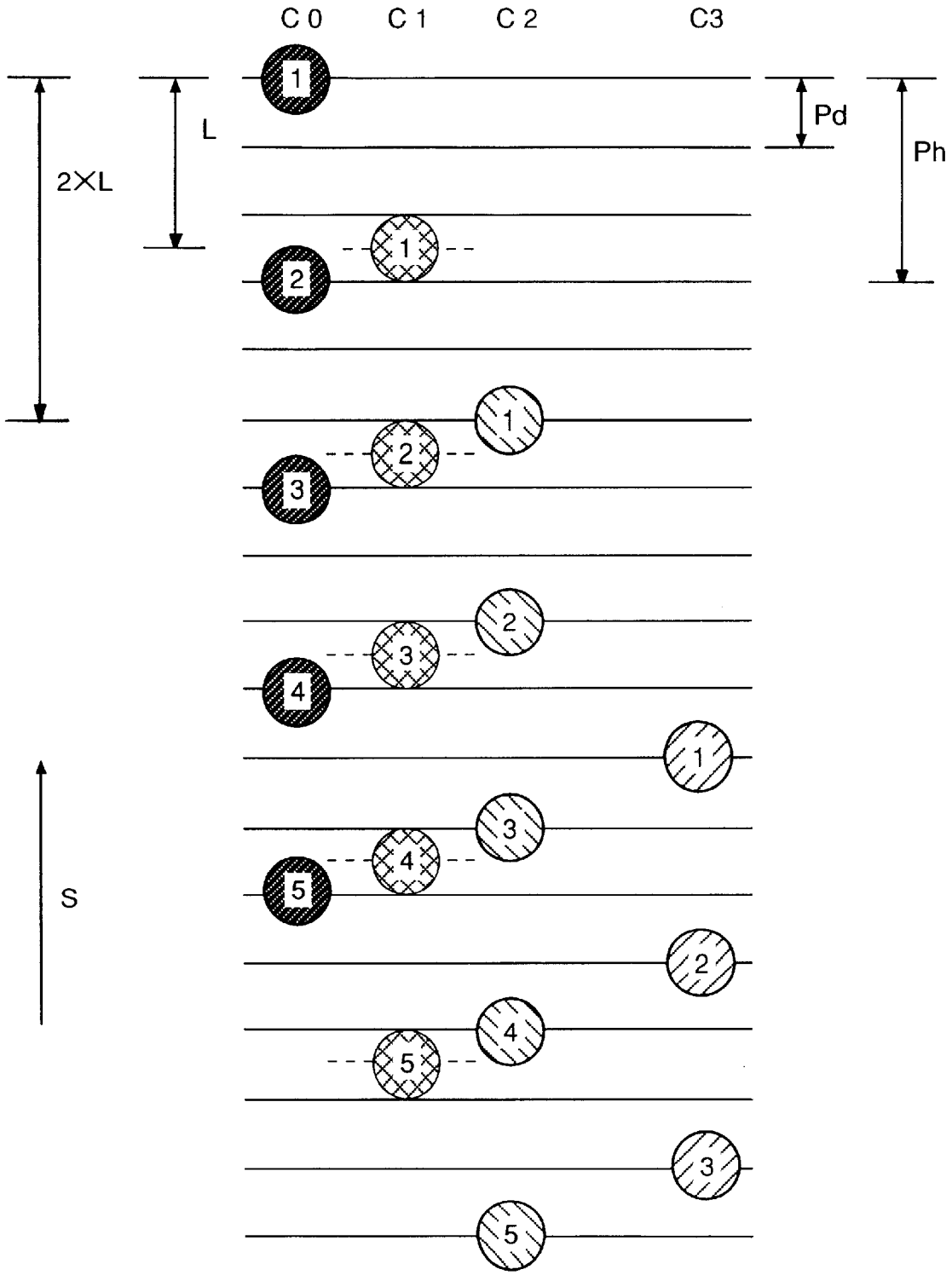
FIG. 15 is an illustration of the relationship among a feed quantity L of a recording medium corresponding to the minimum drive unit of a conveying motor, a pitch Ph of nozzles in a print head and a pitch Pd of recording dots to be formed on the recording medium in a fourth embodiment.

FIG. 15 is an illustration of the relationship among a feed quantity L of a recording medium corresponding to the minimum drive unit of a conveying motor, a pitch Ph of nozzles of a print head and a pitch Pd of recording dots to be formed on the recording medium in a fourth embodiment. Incidentally, the fourth embodiment is also realizable with the recording apparatus shown in FIG. 1.

As shown in FIG. 15, the print head nozzle pitch Ph is three times the pitch Pd of recording dots to be formed on the recording medium, and the feed quantity L of the recording medium corresponding to the minimum drive unit of the conveying motor is 2.5 times the pitch Pd of recording dots to be formed on the recording medium.

A print column C0 indicates nozzle positions of the print head along the feed direction S of the recording medium, and each of the nozzle positions is represented by a number.

If the recording medium is forwarded by the feed quantity L in the feed direction S indicated in FIG. 15, the print head is shifted relatively with the recording medium as indicated by print columns C1 and C2, and hence, recording dots can be formed on the recording medium at the predetermined recording dot pitch Pd.

In this case, since a value corresponding to odd-number times the feed quantity L does not establish the predetermined dot pitch Pd, a value corresponding to even-number times the feed quantity L is used as the feed quantity Ln for the formation of the recording dots at the pitch Pd, and the dot formation positions are taken as indicated by columns C2 and C3.

More specifically, even in the case of employing a print head having nozzles disposed at a nozzle pitch 3Pd forming three times the recording dot pitch Pd, if the minimum integer (in this embodiment, "5") forming integer (in this embodiment, "2") times a value (in this embodiment, "2.5") obtained by dividing the feed quantity L of the recording medium corresponding to the minimum drive unit of the drive motor by the predetermined pitch Pd of recording dots placed on the recording medium is divided by an integer (in this embodiment, "3") obtained by dividing the print head nozzle pitch Ph by the recording dot pitch Pd and the residue (in this embodiment, "2") is not a divisor, above "2", of the integer (in this embodiment, "2") obtained by dividing the print head nozzle pitch Ph by the recording dot pitch Pd, as shown in FIG. 15, the print head can be shifted relatively with respect to the recording medium, and even in the case of using a print head having nozzles disposed at the nozzle pitch 3Pd being three times the recording dot pitch Pd, the formation of recording dots is realizable at the predetermined recording dot pitch Pd.

Although the description of this embodiment has been made of the case that Ph/Pd=3 and L=2.5 Pd, if values m, n and K which satisfy the following relations exist, the above-mentioned relation is naturally realizable.

$$L > Pd$$

$$m \times L = n \times Ph + K \times Pd$$

m: a minimum integer making "m×L" as an integer n: an arbitrary integer above 0

K: any one of integers from 1 to {(Ph/Pd)−1} except divisors, but 1, of an integer "Ph/Pd"

Figure 16:
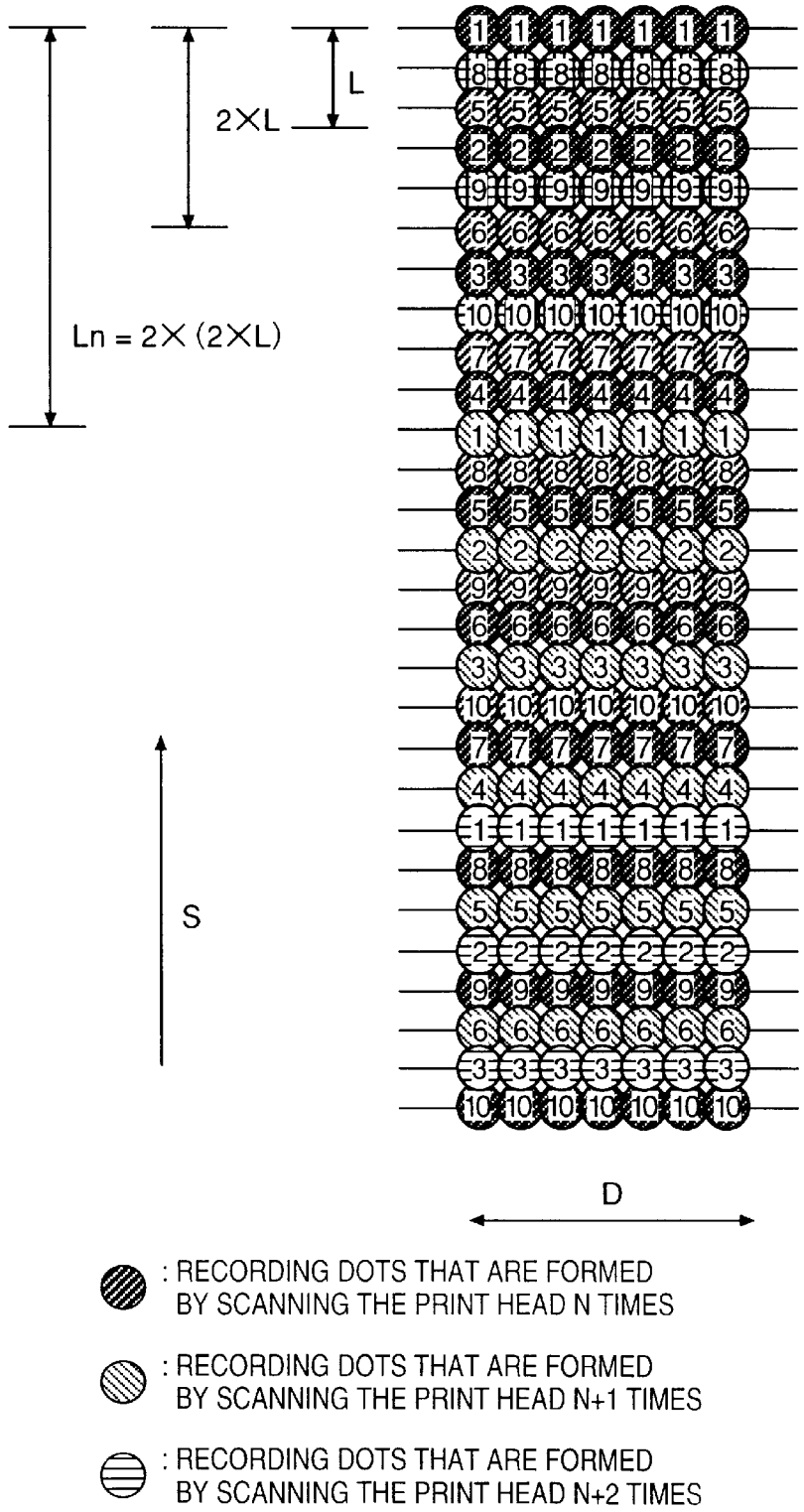
FIG. 16 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium in FIG. 15 are determined on the condition that the number of nozzles of the print head is at 10 and the feed quantity Ln of the recording medium per line is set to Ln=2×(2×L)

FIG. 16 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium are determined on the condition that the number of nozzles of the print head is at 10 and the feed quantity Ln of the recording medium per line is set to Ln=2×(2×L).

FIG. 16 also shows an example of recording dots formed by scanning the print head plurality of times. Each numerals of the dots corresponds to the nozzles respectively.

When the feed quantity L of a recording medium corresponding to the minimum drive unit of a conveying motor, the pitch Ph of nozzles in a print head and the pitch Pd of recording dots to be formed on the recording medium are set on the above-mentioned condition, as compared with the case that the feed quantity L of a recording medium corresponding to the minimum drive unit of a drive motor is set to be equal to the recording dot pitch Pd like the prior art, the recording medium can be forwarded at a several times higher speed.

Moreover, in the case that the recording medium feed speed is set to be equal to that in the prior art, even a low-priced stepping motor providing a lower number of steps to be taken per a constant time is available, which contributes to the reduction of the cost of the recording apparatus.

In addition, in this embodiment, since for the conveyance the feed quantity Ln in the feed direction S is always taken to be even-number times the minimum drive unit of the conveying motor (that is, integer times of 2L), and therefore, if the motor to be put to use is a two-phase stepping motor, the factor for the rotational angle errors due to the phase of the motor is reset at 2L, thereby providing higher-accuracy feeding (sub-scanning). Incidentally, although this embodiment takes m=2, if a three-phase motor is taken, m=3, and if a five-phase motor is employed, m=5, and even in these cases, naturally the same effects are obtainable.-Please <Fifth Embodiment>

Figure 17:
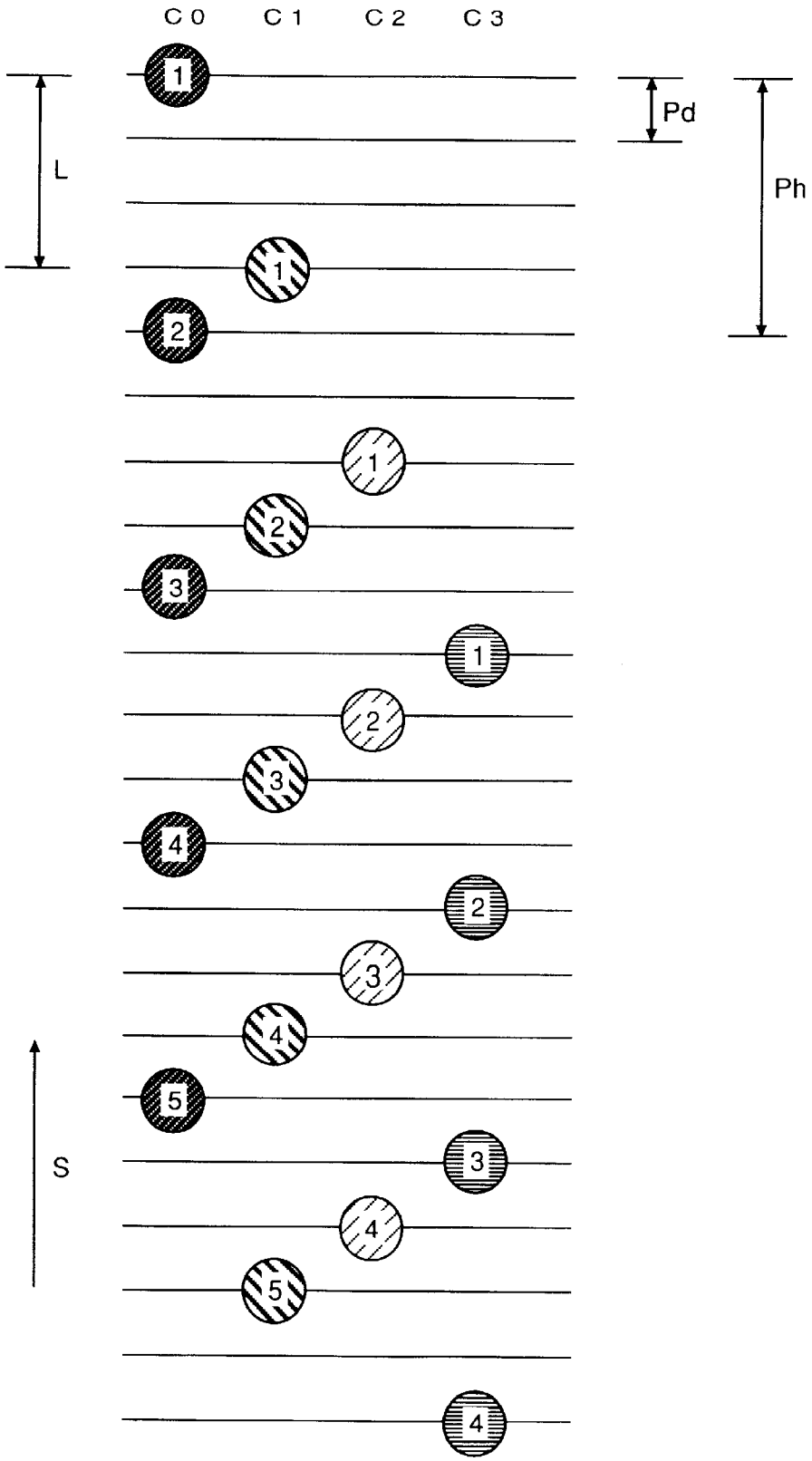
FIG. 17 is an illustration of the relationship among a feed quantity L of a recording medium corresponding to the minimum drive unit of a conveying motor, a pitch Ph of nozzles in a print head and a pitch Pd of recording dots to be formed on the recording medium in a fifth embodiment.

FIG. 17 is an illustration of the relationship among a feed quantity L of a recording medium corresponding to the minimum drive unit of a conveying motor, a pitch Ph of nozzles of a print head and a pitch Pd of recording dots to be formed on the recording medium in a fifth embodiment. Incidentally, the fifth embodiment is also realizable with the recording apparatus shown in FIG. 1.

As shown in FIG. 17, the print head nozzle pitch Ph is four times the pitch Pd of recording dots to be formed on the recording medium, and the feed quantity L of the recording medium corresponding to the minimum drive unit of the conveying motor is three times the pitch Pd of recording dots to be formed on the recording medium.

A print column C0 indicates nozzle positions of the print head along the feed direction S of the recording medium, and each of the nozzle positions is represented by a number.

If the recording medium is forwarded by the feed quantity L in the feed direction S indicated in FIG. 17, the print head is shifted relatively with the recording medium as indicated by print columns C1, C2 and C3, and hence, recording dots can be formed on the recording medium at the predetermined recording dot pitch Pd.

Figure 19:
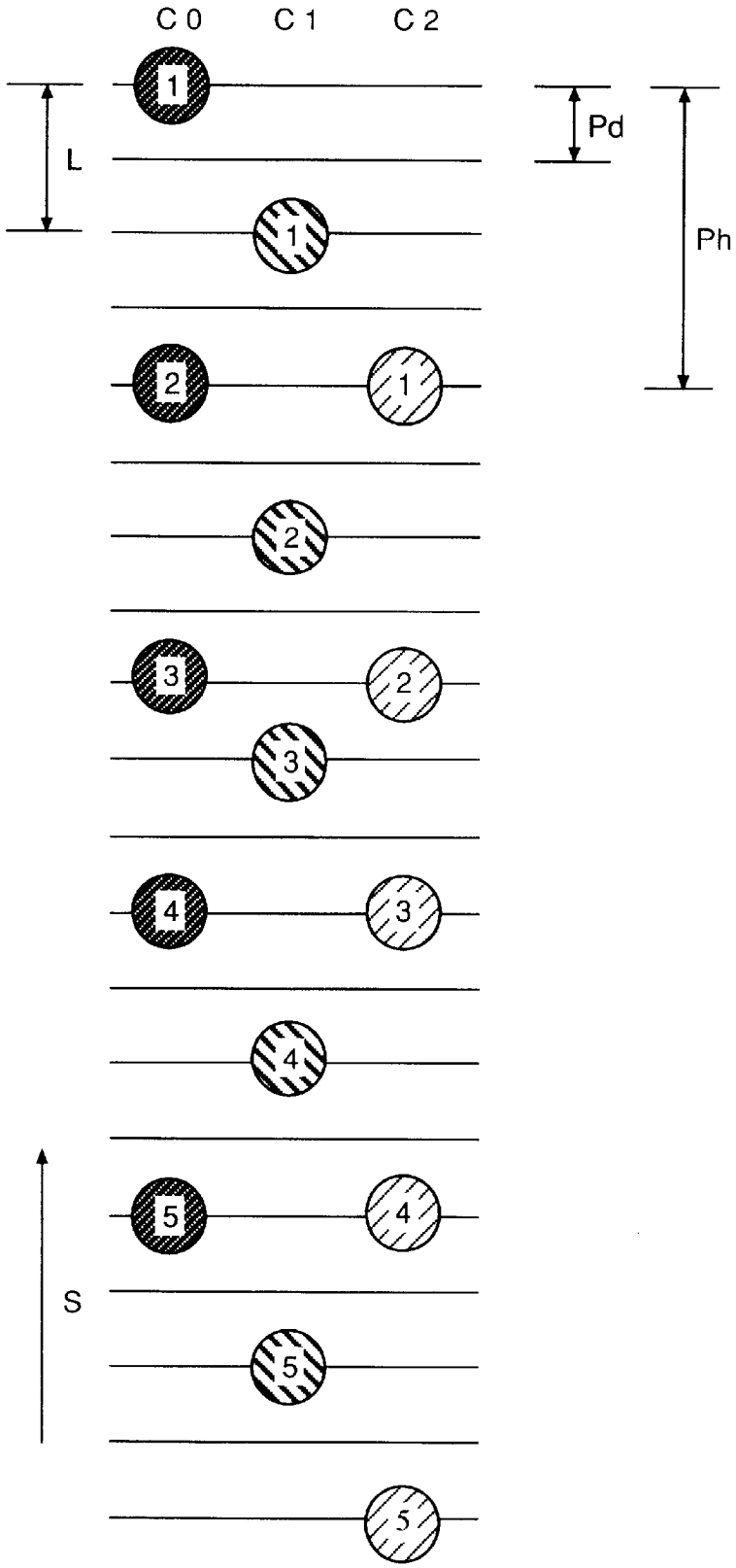
FIG. 19 is a illustration of a print pattern when a print he nozzle pitch is even-number times a pitch of recording dots to be formed on a recording medium in FIG. 21.

In the case that the print head nozzle pitch Ph is four times the pitch Pd of recording dots to be formed on the recording medium and the feed quantity L of the recording medium corresponding to the minimum drive unit of the conveying motor is twice the recording dot pitch Pd, as shown in FIG. 19, difficulty is encountered in relatively shifting the print head in the feed direction except for positions corresponding to even-number times of Pd as integer times the minimum drive unit. That is, when the minimum integer forming integer times a value obtained by dividing the feed quantity of the recording medium corresponding to the minimum drive unit of the conveying motor by the pitch Pd of recording dots to be formed on the recording medium is divided by an integer obtained by dividing the print head nozzle pitch Ph by the pitch Pd of recording dots to be formed on the recording medium, if that residue is a divisor of the integer obtained by dividing the print head nozzle pitch Ph by the pitch Pd of recording dots to be formed on the recording medium, even if the feed quantity L is set to arbitrary integer times, the print head can be shifted relatively to only the positions where the print head nozzle pitch Ph is divided by its divisor, and hence, a necessary dot pitch is not realizable with plural times the feed quantity L.

On the other hand, even in the case of employing a print head having nozzles disposed at a nozzle pitch 4 Pd forming four times the recording dot pitch Pd. if the minimum integer (in this embodiment, "3") forming integer (in this embodiment, "1") times a value (in this embodiment, "3") obtained by dividing the feed quantity L of the recording medium corresponding to the minimum drive unit of the drive motor by the predetermined pitch Pd of recording dots placed on the recording medium is divided by an integer (in this embodiment, "4") obtained by dividing the print head nozzle pitch Ph by the recording dot pitch Pd and the residue (in this embodiment, "3") is not a divisor, above "2", of the integer (in this embodiment, "4") obtained by dividing the print head nozzle pitch Ph by the recording dot pitch Pd, as shown in FIG. 17, the print head can be shifted relatively with respect to the recording medium, and even in the case of using a print head having nozzles disposed at the nozzle pitch 4Pd being four times the recording dot pitch Pd, the formation of recording dots is feasible at the predetermined recording dot pitch Pd.

Although the description of this embodiment has been made of the case that Ph/Pd=4 and L=3 Pd, if values m, n and K which satisfy the following relations exist, the above-mentioned relation is naturally realizable.

$$L>Pd$$

$$m\times L=n\times Ph+K\times Pd$$

m: a minimum integer making "m×L" as an integer n: an arbitrary integer above 0

K: any one of integers from 1 to {(Ph/Pd)−1} except divisors, but 1, of an integer "Ph/Pd"

Figure 18:
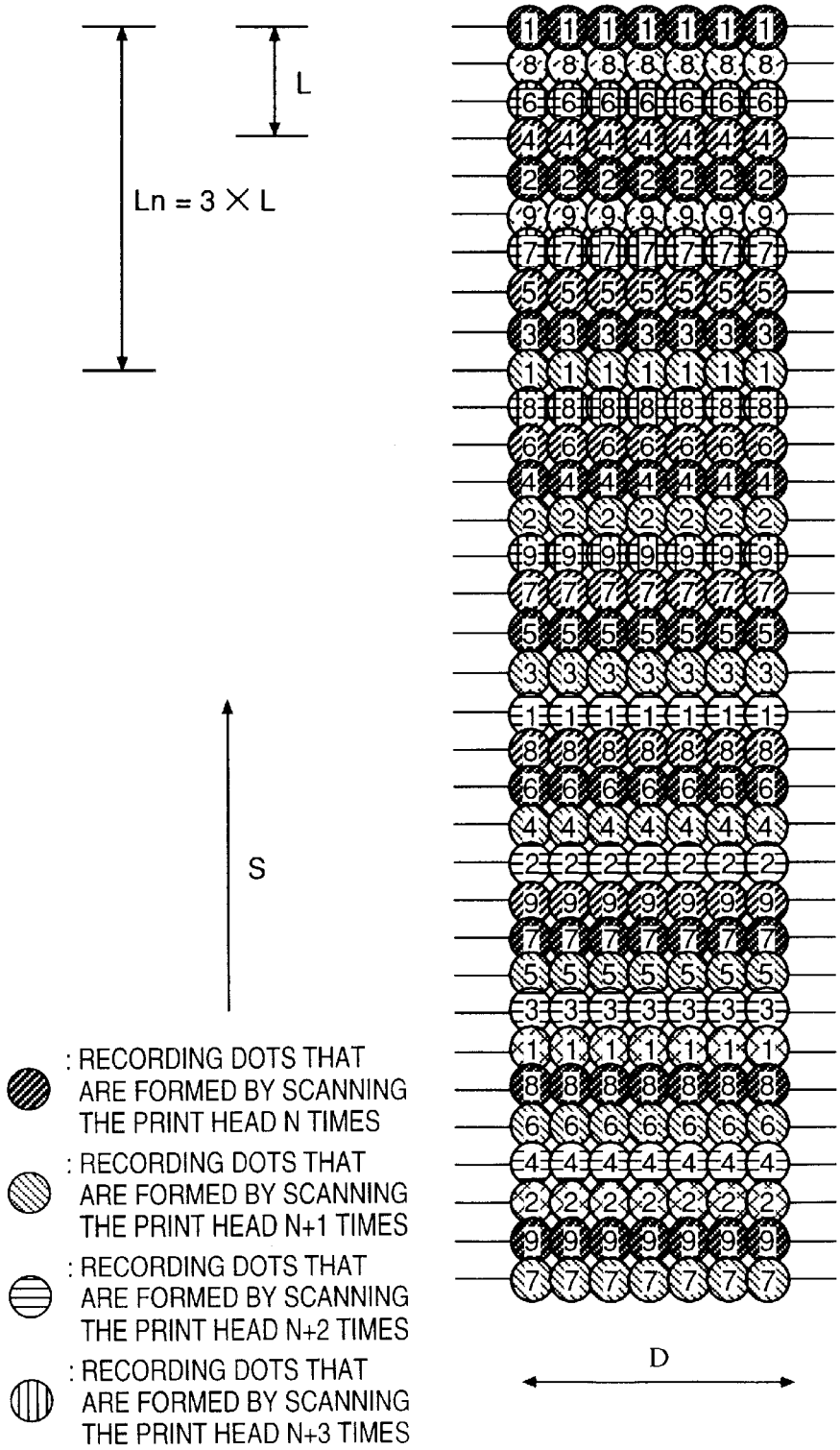
FIG. 18 if an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium in FIG. 17 are determined on the condition that the number of nozzles of the print head is at 9 and the feed quantity Ln of the recording medium per line is set to Ln=3×L.

FIG. 18 is an illustration of a state of recording dots formed in the case that the feed quantity L of a recording medium corresponding to the minimum drive unit of a conveying motor, the pitch Ph of nozzles in a print head and the pitch Pd of recording dots to be formed on the recording medium are determined on the condition that the number of nozzles of the print head is at 9 and the feed quantity Ln of the recording medium per line is set to Ln=3×L.

FIG. 18 also shows an example of recording dots formed by scanning the print head plurality of times. Numerals of the dots corresponds to the nozzles respectively.

When the feed quantity L of a recording medium corresponding to the minimum drive unit of a conveying motor, the pitch Ph of nozzles in a print head and the pitch Pd of recording dots to be formed on the recording medium are set on the above-mentioned condition, as compared with the case that the feed quantity L of a recording medium corresponding to the minimum drive unit of a drive motor is set to be equal to the recording dot pitch Pd like the prior art, the recording medium can be forwarded at a several times higher speed.

Moreover, in the case that the recording medium feed speed is set to be equal to that in the prior art, even a low-priced stepping motor providing a lower number of steps to be taken per a constant time is available, which contributes to the reduction of the cost of the recording apparatus.

The above-described embodiments can accomplish the enhancement of the record density and precision by employing, particularly in ink jet recording types, a type which is equipped with a means (for example, an electro-thermal transducer or laser light) to generate thermal energy as an energy to be used for discharging ink and causes a state variation of the ink by the thermal energy.

Preferably, the typical construction and principle are based upon the basic principle disclosed in U.S. Pat. Nos. 4,723,129 or 4,740,796. Although this type is applicable to both so-called on-demand type and continuous type, particularly, the on-demand type is effective because, in a manner that at least one drive signal corresponding to record information for providing a rapid temperature rise exceeding the film boiling is applied to an electro-thermal transducer located in connection with a sheet retaining a liquid (ink) or a liquid passage, the electro-thermal transducer is made to generate thermal energy to cause the film boiling on a heat working surface of a print head so that the formation of a bubble in the liquid (ink) is possible in one-to-one relation to this drive signal. The liquid (ink) is discharged through a discharging opening by the growth and contraction to develop at least one droplet. If this drive signal is made in the form of a pulse, since the growth and contraction of the bubble immediately and appropriately take place, liquid (ink) discharge excellent in response is achievable, and therefore, it is more preferable.

As this drive signal having a pulse configuration, it is desirable to use a signal disclosed in U.S. Pat. No. 4,463,359 or 4,345,262. Incidentally, if employing the condition about the temperature rise rate on the aforesaid heat working surface disclosed in U.S. Pat. No. 4,313,124, more excellent recording is possible.

As the construction of the print head, in addition to a construction based upon a combination of discharging ports, liquid passages and a electro-thermal transducer (linear liquid passage or rectangular liquid passage) disclosed in the above-mentioned documents, this invention covers the construction in which a heat working surface exists in a bent area, disclosed in U.S. Pat. No. 4,558,333 or 4,459,600. besides, it is also possible to use the construction in which a slot common to a plurality of electro-thermal transducers is used as a discharging section of the electro-thermal transducers as disclosed in Japanese Unexamined Patent Publication No. 59-123670 or employ the construction in which an opening for absorbing pressure waves of thermal energy is made to correspond to a discharging section as disclosed in Japanese Unexamined Patent Publication No. 59-138461.

As a full line type print head having a length corresponding to the width of the largest recording medium the recording apparatus can record on, it is acceptable to use a construction which satisfies that length by the combination of a plurality of print heads as disclosed in the above-mentioned documents, or to use one print head integrally constructed.

Moreover, in addition to a cartridge type print head in which an ink tank is attached integrally to the print head itself in the above-described embodiments, it is also possible to use a replaceable chip type print head which is allowed to make an electrical connection with the apparatus body or to receive the supply of ink from the apparatus body in a state of being mounted on the apparatus body.

Furthermore, to make the recording operation more stable, it is preferable to add a recovery means for the print head, a preliminary means or the like to the above-described constructions of the recording apparatus. In detail, as the means to be added, there are a capping means for the print head, a cleaning means, a pressurizing or sucking means, an electro-thermal transducer, a different heating device, a preliminary heating means comprising a combination of heating devices, and others. In addition, having a preliminary discharging mode for conducting the discharge which is not for the recording is also effective with a view to effecting stable recording.

Still further, although as the recording mode of the recording apparatus, in addition to a recording mode using only a main color such as black, it is possible to take a means for providing a plurality of different colors or at least one of full color based on color mixture by using an integrally constructed print head or a combination of a plurality of print heads.

Although the description of the above-described embodiments has been made on the assumption that the ink is a liquid, it is also possible to use ink solidified at the room temperature or below or to use ink softened or liquefied at the room temperature. In addition, it is also possible to use ink taking a liquid condition at the supply of a record signal to be used, for that, in general, in the ink jet type, the temperature control is done such that the ink itself is temperature-adjusted within a range between 30° C. and 70° C. to put the viscosity of the ink within a stable discharge range.

Moreover, in order to positively use the temperature rise by the thermal energy as an energy for the state variation from the solidified state to the liquefied state or to prevent the evaporation of ink, it is also possible to use ink solidified in the left condition and liquefied by heating. In either case, this invention is also applicable to the case of using ink liquefied by giving thermal energy corresponding to a record signal so that the liquefied ink is discharged and the case of using ink having a property whereby solidification starts at the arrival of the recording medium and liquefaction occurs for the first time due to the supply of thermal energy. In this case, it is also appropriate that the ink faces the electro-thermal transducer in a state of being held in recess portions of a porous sheet or through holes thereof as a liquid material or a solid material as disclosed in Japanese Unexamined Patent Publication No. 54-56847 or No. 60-71260. In this invention, the aforesaid film boiling type is most effective for the above-mentioned ink.

Besides, the recording apparatus according to this invention can be a recording apparatus serving as an image outputting terminal of information processing equipment such as a computer integrally or separately installed, a copying machine including a reader, or a facsimile having a signal transmission and reception function.

<Other Embodiment>

This invention is applicable to a system comprising a plurality of equipment (for example, a host computer, an interface device, a reader, a printer, and others) or to an apparatus comprising one equipment (for example, a copying machine, a facsimile, and others).

Furthermore, naturally, the object of this invention is achievable even in a manner that a storage medium storing a program code of a software for realizing the functions of the above-described embodiments is supplied to a system or an apparatus and a computer (CPU or MPU) of the system or the apparatus reads out and implements the program code from the storage medium.

In this case, the program code itself read out from the recording medium realizes the function of each of the above-described embodiments, and the storage medium storing the program code constitutes this invention.

As the storage medium to be used for the supply of the program code, for example, there are a floppy disk, a hard disk, an optical disk, a magneto optical disk, a CD-ROM, a CD-R, a magnetic tape, a non-volatile memory card, a ROM, and others.

Furthermore, naturally, this invention covers the case that the functions of the above-described embodiments can be fulfilled in a manner that the computer executes the program code read out, and the case that an OS (Operating System) or the like operating on the computer conducts a portion of or all the actual processing in accordance with an instruction indicated by the program code to realize the functions of the above-described embodiments.

Still further, naturally, this invention covers the case that, after the program code read out from the storage medium is written in a memory associated with an extended board inserted into the computer or an extended unit connected to the computer, the CPU concerned with the extended board or the extended unit executes a portion of or all the actual processing on the basis of an instruction indicated by the program code to fulfill the functions of the above-described embodiments.

Figure 20:
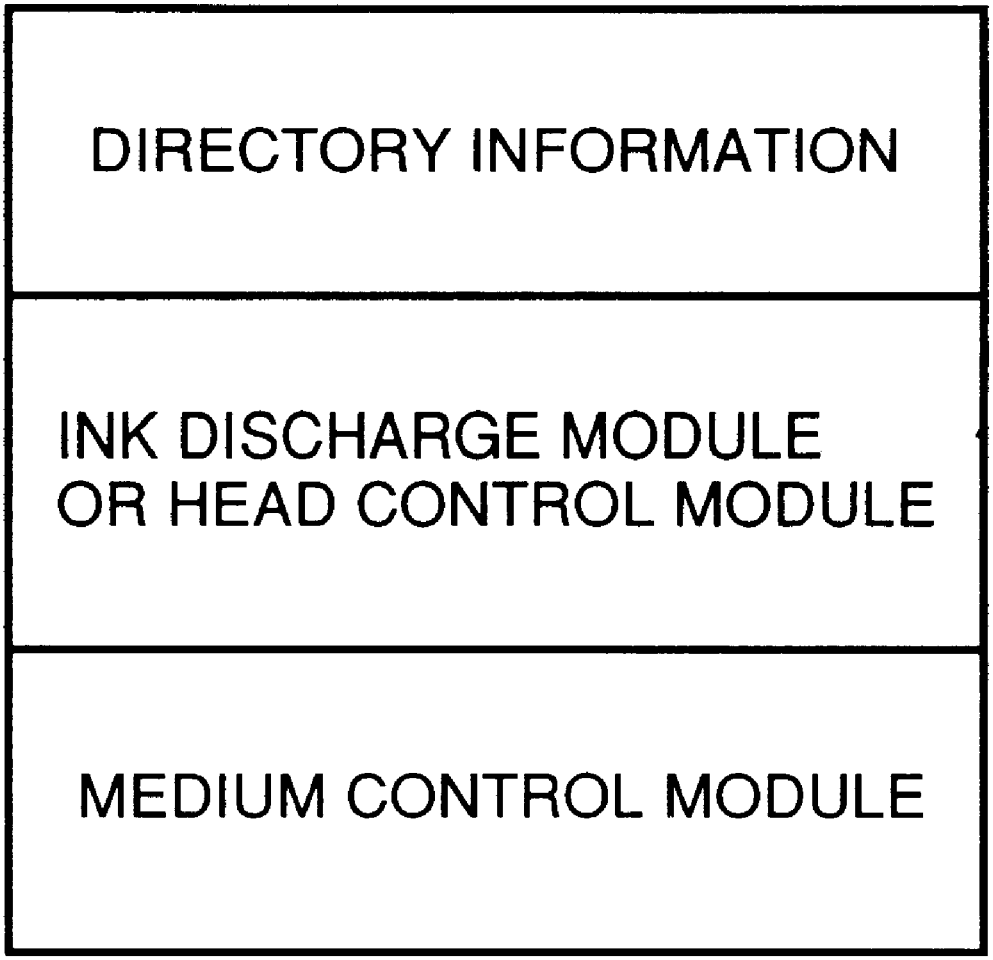
FIG. 20 is an illustration of an example of a memory map of a storage medium storing a program code for a control method for a recording apparatus according to this invention.
Figure 21:
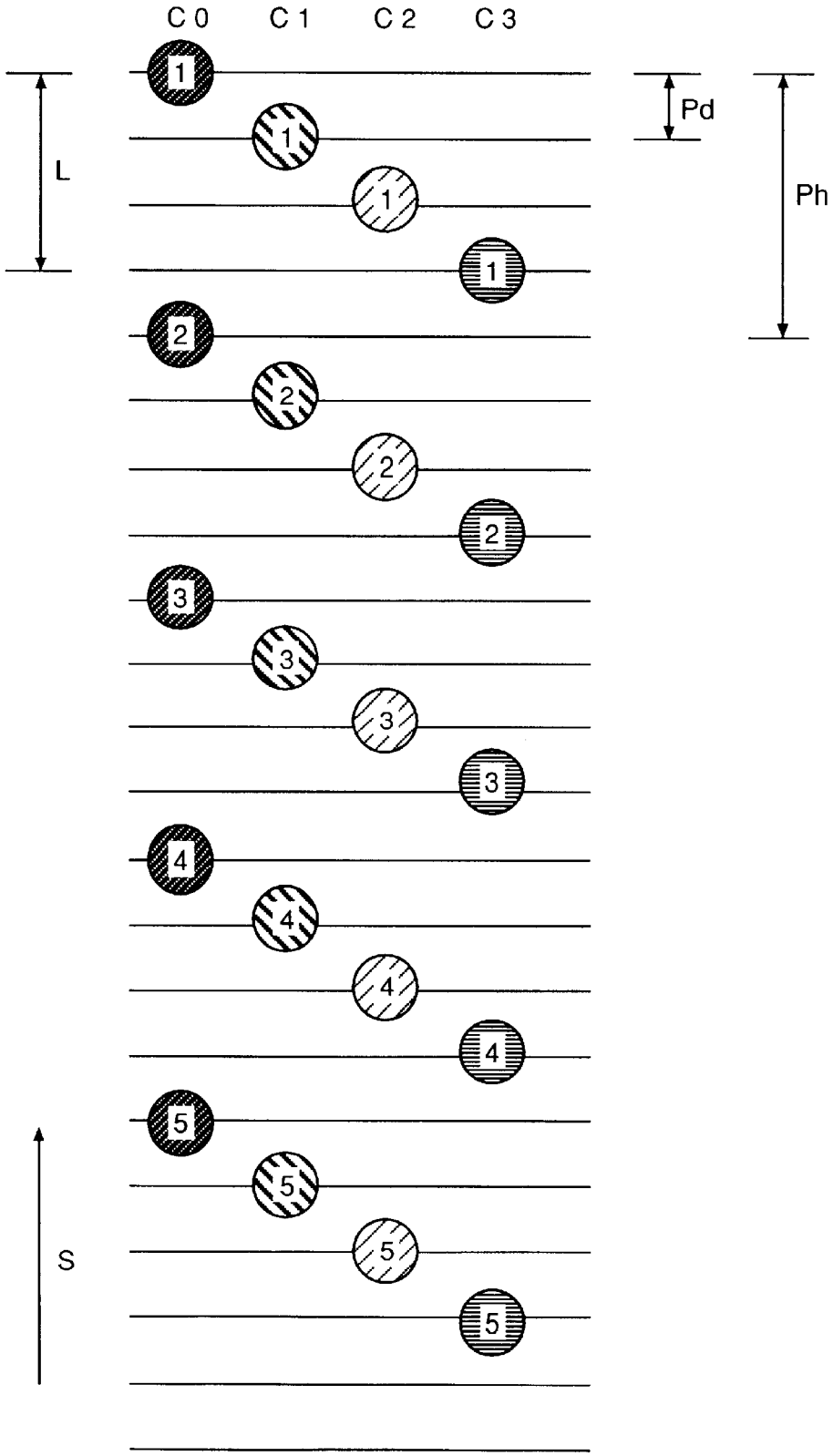
FIG. 21 is an illustration of a print pattern when a print head nozzle pitch is integer times a pitch of recording dots to be formed on a recording medium.

In the case that this invention is applied to the aforesaid storage medium, the program code conforming to the above-mentioned flow charts and control conditions is stored in that storage medium. Briefly, each of modules shown in a memory map example of FIG. 20 is stored in the storage medium. That is, the program code for at least the modules:

"ink discharging module" or "head control module" and "medium control module" is merely stored in the storage medium.

As described above, according to this invention, ink is discharged from the print head onto a recording medium at a recording dot pitch obtained by dividing a predetermined pitch of discharge ports by an integer above 2, and the medium drive means is controlled so that the feed quantity of the recording medium corresponding to the minimum drive unit of the medium drive means becomes larger than a pitch of recording dots to be formed on the recording medium, whereupon it is possible to increase the recording medium feed speed, to reduce the cost, and further, to accomplish high quality recording at a small recording dot pitch.

In addition, the medium drive means is controlled to satisfy the condition that, when the pitch of discharge ports is taken to be Ph and the recording dot pitch is taken as Pd, $Ph/Pd \geqq 2$ and $L>Pd$, whereupon it is possible to increase the recording medium feed speed, to reduce the cost, and further, to accomplish high-quality recording at a small recording dot pitch.

The present invention is not limited to the above embodiments and various changes and modifications can be made within the spirit and scope of the present invention. Therefore, to apprise the public of the scope of the present invention the following claims are made.

What is claimed is:

1. A recording apparatus comprising:

a recording head having a plurality of discharge ports for discharging inks, said plurality of discharge ports being arranged at a predetermined pitch;

scanning means for scanning said recording head in scanning directions;

conveying means for conveying a recording medium in a conveying direction; and control means for controlling said conveying means at integer times a minimum conveying unit, wherein said control means controls said conveying means so that ink is discharged onto the recording medium at a pitch of recording dots obtained by dividing the predetermined pitch of said discharge ports by an integer greater than 2, and a conveying quantity of the recording medium corresponding to the minimum conveying unit of said conveying means is larger than the pitch of the recording dots to be formed on the recording medium, wherein a value obtained by dividing the conveying quantity of the recording medium by the recording dot pitch is a rational number, and when a minimum integer that is an integer multiple of the value is divided by an integer obtained by dividing the predetermined pitch of said discharge ports by the recording dot pitch, the remainder is not a divisor, greater than 2, of the integer obtained by dividing the predetermined pitch by the recording dot pitch.

2. The recording apparatus according to claim 1, wherein said conveying means comprises a stepping motor.

3. The recording apparatus according to claim 2, wherein the value obtained by dividing the conveying quantity of the recording medium by the recording dot pitch is a rational number, and a minimum integer that is an integer multiple of the value corresponds to the number of phases of said stepping motor.

4. The recording apparatus according to claim 1, wherein said conveying means comprises a motor with an encoder.

5. The recording apparatus according to claim 1, wherein said recording head comprises an ink jet recording head which discharges ink for recording.

6. The recording apparatus according to claim 1, wherein said recording head comprises a recording head which discharges ink through the use of thermal energy, and is equipped with a thermal energy transducer for generating the thermal energy to be applied to the ink.

7. A recording apparatus comprising:

a recording head having a plurality of discharge ports for discharging inks, said plurality of discharge ports being arranged at a predetermined pitch;

scanning means for scanning said recording head in scanning directions;

conveying means for conveying a recording medium in a conveying direction; and control means for controlling said conveying means at integer times a minimum conveying unit, wherein said recording head discharges ink onto the recording medium at a pitch of recording dots obtained by dividing the predetermined pitch of said discharge ports by an integer greater than 2, while said control means controls said conveying means to satisfy $L>Pd$, where L is a conveying quantity of the recording medium, Ph is the pitch of said discharge ports, Pd is the recording dot pitch, and $Ph/Pd \geqq 2$, wherein, where m is a minimum integer making $m \times L$ equal an integer, n is an arbitrary integer above 0 and K is any one of integers from 1 to $(Ph/Pd)-1$ except all divisors, but 1, of an integer Ph/Pd, L, Ph and Pd satisfy a condition of $m \times L = n \times Ph + K \times Pd$.

8. The recording apparatus according to claim 7, wherein said conveying means comprises a stepping motor.

9. The recording apparatus according to claim 7, wherein said conveying means comprises a motor with an encoder.

10. The recording apparatus according to claim 7, wherein the integer corresponds to the number of phases of said stepping motor.

11. The recording apparatus according to claim 7, wherein said recording head comprises an ink jet recording head which discharges ink to effect recording.

12. The recording apparatus according to claim 7, wherein said recording head discharges ink through the use of thermal energy, and comprises a thermal energy transducer for generating the thermal energy to be applied to the ink.

13. A method of controlling a recording apparatus comprising a recording head having a plurality of discharge ports for discharging inks, said plurality of discharge ports being arranged at a predetermined pitch, scanning means for scanning said recording head in scanning directions, conveying means for conveying a recording medium in a conveying direction, and control means for controlling said conveying means at integer times a minimum conveying unit, said method comprising the steps of:

controlling said recording head so that the ink is discharged onto the recording medium at a recording dot pitch obtained by dividing the predetermined pitch of said discharge ports by an integer greater than 2; and controlling said conveying means so that a conveying quantity of the recording medium corresponding to a minimum conveying unit of said conveying means is larger than the pitch of the recording dots to be formed on the recording medium, wherein a value obtained by dividing the conveying quantity of the recording medium by the recording dot pitch is a rational number, and when a minimum integer that is an integer multiple of the value is divided by an integer obtained by dividing the predetermined pitch of said discharge ports by the recording dot pitch, the remainder is not a divisor, greater than 2, of the integer obtained by dividing the predetermined pitch by the recording dot pitch.

14. A method of controlling a recording apparatus comprising a recording head having a plurality of discharge ports for discharging inks, said plurality of discharge ports being arranged at a predetermined pitch, scanning means for scanning said recording head in scanning directions, conveying means for conveying a recording medium in a conveying direction, and control means for controlling said conveying means at integer times a minimum conveying unit, said method comprising the steps of:

controlling said recording head so that the ink is discharged onto the recording medium at a recording dot pitch obtained by dividing the predetermined pitch of said discharge ports by an integer greater than 2; and controlling said conveying means so that $L>Pd$, where L is a conveying quantity of the recording medium, Ph is the pitch of said discharge ports, Pd is the recording dot pitch, and $Ph/Pd \geqq 2$, wherein, where m is a minimum integer making $m \times L$ equal an integer, n is an arbitrary integer above 0 and K is any one of integers from 1 to $(Ph/Pd)-1$ except all divisors, but 1, of an integer Ph/Pd, L, Ph and Pd satisfy a condition of $m \times L = n \times Ph + K \times Pd$.

15. A memory readable by a computer in which a program code is stored to control a recording apparatus comprising a recording head having a plurality of discharge ports for discharging inks, said plurality of discharge ports being arranged at a predetermined pitch, scanning means for scanning said recording head in scanning directions, conveying means for conveying a recording medium in a conveying direction, and control means for controlling said conveying means at integer times a minimum conveying unit, said memory retaining:

an ink discharge process code for discharging the ink onto the recording medium at a pitch of recording dots obtained by dividing the predetermined pitch of said discharge ports by an integer greater than 2; and a medium control process code for controlling said conveying means so that a conveying quantity of the recording medium corresponding to the minimum conveying unit of said conveying means is larger than the pitch of the recording dots to be formed on the recording medium, wherein a value obtained by dividing the conveying quantity of the recording medium by the recording dot pitch is a rational number, and when a minimum integer that is an integer multiple of the value is divided by an integer obtained by dividing the predetermined pitch of said discharge ports by the recording dot pitch, the remainder is not a divisor, greater than 2, of the integer obtained by dividing the predetermined pitch by the recording dot pitch.

16. A memory readable by a computer in which a program code is stored to control a recording apparatus comprising a recording head having a plurality of discharge ports for discharging inks, said plurality of discharge ports being arranged at a predetermined pitch, scanning means for scanning said recording head in scanning directions, conveying means for conveying a recording medium in a feeding direction, and control means for controlling said conveying means at integer times a minimum conveying unit, said program code in said memory conducting:

head control processing for controlling said recording head so that said ink is discharged onto the recording medium at a recording dot pitch obtained by dividing the predetermined pitch of said discharge ports by an integer greater than 2; and medium control processing for controlling said conveying means so that $L>Pd$, where L is a conveying quantity of the recording medium, Ph is the pitch of said discharge ports, Pd is the recording dot pitch, and $Ph/Pd \geqq 2$, wherein, where m is a minimum integer making $m \times L$ equal an integer, n is an arbitrary integer above 0 and K is any one of integers from 1 to $(Ph/Pd)-1$ except all divisors, but 1, of an integer Ph/Pd, L, Ph and Pd satisfy a condition of $m \times L = n \times Ph + K \times Pd$.

* * * * *

UNITED STATES PATENT AND TRADEMARK OFFICE

CERTIFICATE OF CORRECTION

PATENT NO. : 6,341,834 B1
DATED : January 29, 2002
INVENTOR(S) : Yokoi

It is certified that error appears in the above-identified patent and that said Letters Patent is hereby corrected as shown below:

Column 5,
Line 24, "he" should read -- head --.

Column 13,
Line 2, "obtainable.-Please" should read -- obtainable. --.
Line 50, "Pd." should read -- Pd, --.

Signed and Sealed this

Seventh Day of May, 2002

*Attest:*

*Attesting Officer*

JAMES E. ROGAN
*Director of the United States Patent and Trademark Office*